US005796843A

United States Patent [19]

Inanaga et al.

[11] Patent Number: 5,796,843

[45] Date of Patent: Aug. 18, 1998

[54] VIDEO SIGNAL AND AUDIO SIGNAL REPRODUCING APPARATUS

[75] Inventors: Kiyofumi Inanaga, Kanagawa; Yuji Yamada, Tokyo, both of Japan

[73] Assignee: Sony Corporation, Tokyo, Japan

[21] Appl. No.: 513,806

[22] PCT Filed: Feb. 14, 1995

[86] PCT No.: PCT/JP95/00197

§ 371 Date: Sep. 8, 1995

§ 102(e) Date: Sep. 8, 1995

[87] PCT Pub. No.: WO95/22235

PCT Pub. Date: Aug. 17, 1995

[30] Foreign Application Priority Data

| | | | |
|---|---|---|---|
| Feb. 14, 1994 | [JP] | Japan | 6-017601 |
| Feb. 14, 1994 | [JP] | Japan | 6-017602 |
| Mar. 4, 1994 | [JP] | Japan | 6-034975 |
| Mar. 8, 1994 | [JP] | Japan | 6-037254 |

[51] Int. Cl.[6] ..... H04S 5/00; H04R 5/02

[52] U.S. Cl. ..... 381/17; 381/25

[58] Field of Search ..... 381/17, 25

[56] References Cited

U.S. PATENT DOCUMENTS

| | | | |
|---|---|---|---|
| 4,817,149 | 3/1989 | Myers | 381/1 |
| 5,181,248 | 1/1993 | Inanaga et al. | 381/74 |
| 5,495,534 | 2/1996 | Inanaga et al. | 381/25 |
| 5,495,576 | 2/1996 | Ritchey | 395/125 |
| 5,526,183 | 6/1996 | Chen | 359/629 |

*Primary Examiner*—Forester W. Isen

*Attorney, Agent, or Firm*—Jay H. Maioli

[57] ABSTRACT

An object of the present invention is to provide a video signal and audio signal reproducing apparatus in which a sound image reproduced from an audio signal is localized so as to correspond to a picture and a listener can change a positional information thereon. According to the present invention, a real sound image is determined at a position, of objects 117, 118 and 119 on a screen 116 of a TV monitor 115, from which a beam of a position corresponding to a sound source position changed by a position information changer 93. It is possible to form the real sound image on the TV monitor 115 as if a sound was emanated from a position of an image which was displayed on the screen 116 of the TV monitor 115 and corresponded to a changed sound source position.

31 Claims, 20 Drawing Sheets

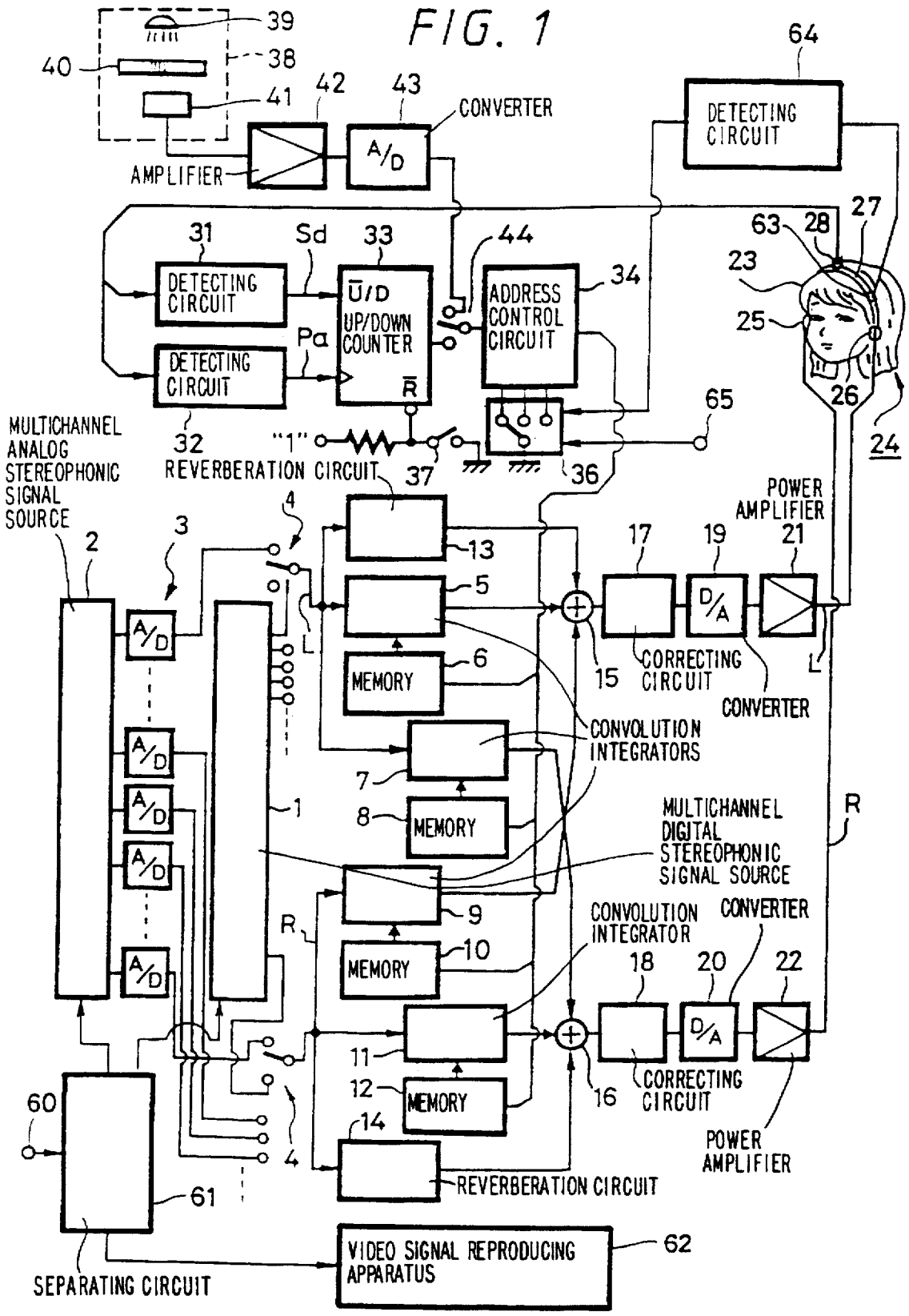
FIG. 1
39
38
40
41
42
43
CONVERTER
AMPLIFIER
A/D
64
DETECTING CIRCUIT
31
Sd
33
44
DETECTING CIRCUIT
Ū/D
UP/DOWN COUNTER
R̄
ADDRESS CONTROL CIRCUIT
34
Pa
DETECTING CIRCUIT
32
63
28
27
23
25
26
24
65
MULTICHANNEL ANALOG STEREOPHONIC SIGNAL SOURCE
"1"
REVERBERATION CIRCUIT
37
36
POWER AMPLIFIER
2
3
4
13
17
19
21
5
D/A
L
MEMORY
6
15
CORRECTING CIRCUIT
CONVERTER
CONVOLUTION INTEGRATORS
7
8
MEMORY
1
MULTICHANNEL DIGITAL STEREOPHONIC SIGNAL SOURCE
R
9
CONVOLUTION INTEGRATOR
CONVERTER
10
MEMORY
18
20
22
11
12
MEMORY
16
CORRECTING CIRCUIT
60
14
POWER AMPLIFIER
REVERBERATION CIRCUIT
61
VIDEO SIGNAL REPRODUCING APPARATUS
62
SEPARATING CIRCUIT

FIG. 4

| $\theta$ | Table Address | Impulse Response $h_{m,n}(t,\theta)$ | | | |
|---|---|---|---|---|---|
| | | $h_{LL}(t,\theta)$ | $h_{LR}(t,\theta)$ | $h_{RL}(t,\theta)$ | $h_{RR}(t,\theta)$ |
| 0° | 0 | $h_{LL}(t,0)$ | $h_{LR}(t,0)$ | $h_{RL}(t,0)$ | $h_{RR}(t,0)$ |
| 2° | 1 | $h_{LL}(t,1)$ | $h_{LR}(t,1)$ | $h_{RL}(t,1)$ | $h_{RR}(t,1)$ |
| 4° | 2 | $h_{LL}(t,2)$ | $h_{LR}(t,2)$ | $h_{RL}(t,2)$ | $h_{RR}(t,2)$ |
| 6° | 3 | $h_{LL}(t,3)$ | $h_{LR}(t,3)$ | $h_{RL}(t,3)$ | $h_{RR}(t,3)$ |
| ⋮ | 4 | ⋮ | ⋮ | ⋮ | ⋮ |
| 358° | 179 | $h_{LL}(t,358)$ | $h_{LR}(t,358)$ | $h_{RL}(t,358)$ | $h_{RR}(t,358)$ |

FIG. 6

| θ | Table Address | Control Data $\Delta T_{IJ}(\theta)$, $\Delta L_{IJ}(\theta)$ | | | |
|---|---|---|---|---|---|
| | | $\Delta T_{LL}(\theta), \Delta L_{LL}(\theta)$ | $\Delta T_{LR}(\theta), \Delta L_{LR}(\theta)$ | $\Delta T_{RL}(\theta), \Delta L_{RL}(\theta)$ | $\Delta T_{RR}(\theta), \Delta L_{RR}(\theta)$ |
| 0° | 0 | $\Delta T_{LL}(0), \Delta L_{LL}(0)$ | $\Delta T_{LR}(0), \Delta L_{LR}(0)$ | $\Delta T_{RL}(0), \Delta L_{RL}(0)$ | $\Delta T_{RR}(0), \Delta L_{RR}(0)$ |
| 2° | 1 | $\Delta T_{LL}(1), \Delta L_{LL}(1)$ | $\Delta T_{LR}(1), \Delta L_{LR}(1)$ | $\Delta T_{RL}(1), \Delta L_{RL}(1)$ | $\Delta T_{RR}(1), \Delta L_{RR}(1)$ |
| 4° | 2 | $\Delta T_{LL}(2), \Delta L_{LL}(2)$ | $\Delta T_{LR}(2), \Delta L_{LR}(2)$ | $\Delta T_{RL}(2), \Delta L_{RL}(2)$ | $\Delta T_{RR}(2), \Delta L_{RR}(2)$ |
| 6° | 3 | $\Delta T_{LL}(3), \Delta L_{LL}(3)$ | $\Delta T_{LR}(3), \Delta L_{LR}(3)$ | $\Delta T_{RL}(3), \Delta L_{RL}(3)$ | $\Delta T_{RR}(3), \Delta L_{RR}(3)$ |
| ⋮ | 4 ⋮ | ⋮ | ⋮ | ⋮ | ⋮ |
| 358° | 179 | $\Delta T_{LL}(179), \Delta L_{LL}(179)$ | $\Delta T_{LR}(179), \Delta L_{LR}(179)$ | $\Delta T_{RL}(179), \Delta L_{RL}(179)$ | $\Delta T_{RR}(179), \Delta L_{RR}(179)$ |

$\Delta T_{IJ}(\theta)$ : Difference in Time Between Sounds Obtained at Both Ears $\Delta L_{IJ}(\theta)$ : Difference in Level Between Sounds Obtained at Both Ears

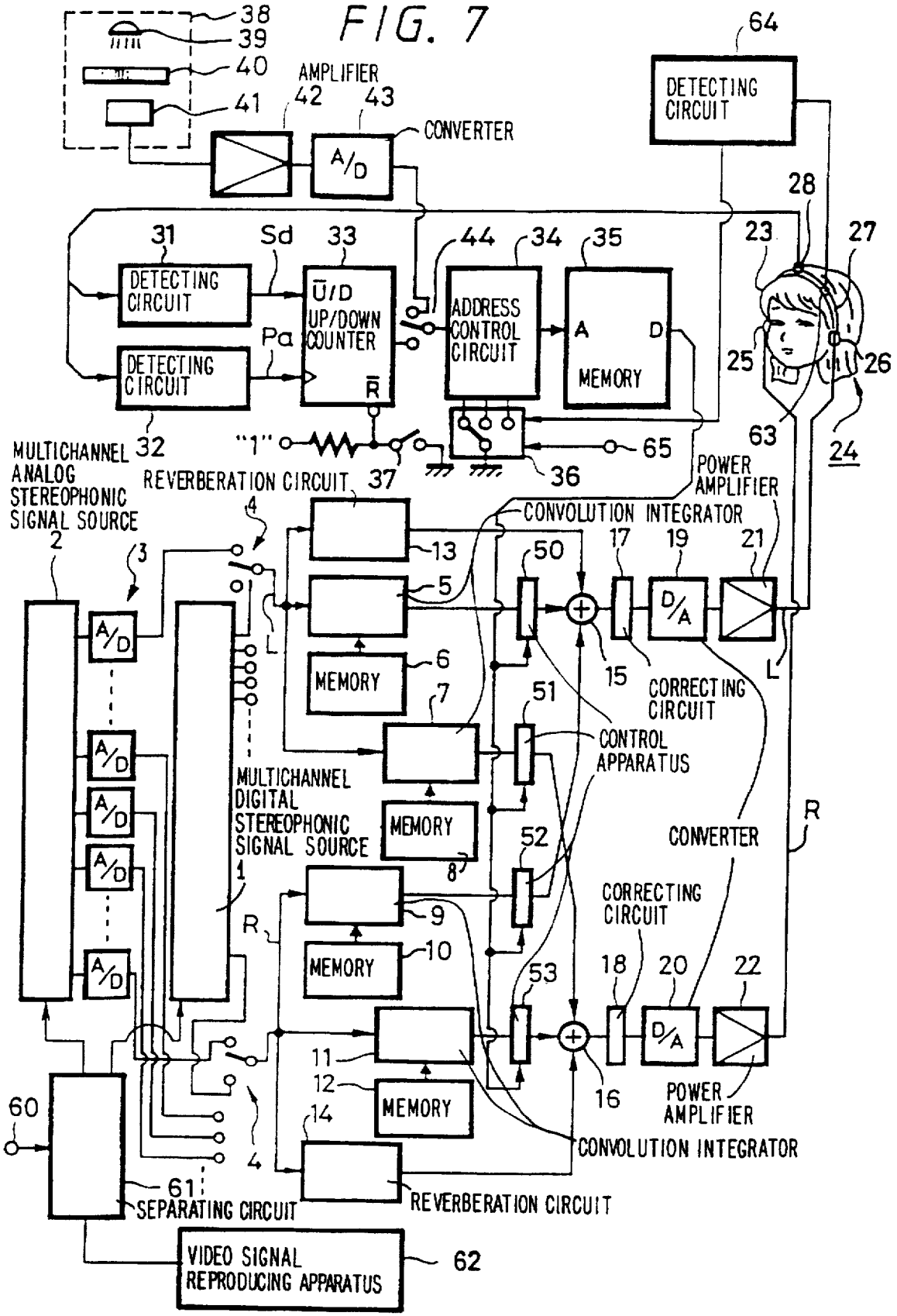
FIG. 7
38
39
40
41
AMPLIFIER
42
43
CONVERTER
A/D
64
DETECTING CIRCUIT
28
23
27
31
Sd
33
44
34
35
DETECTING CIRCUIT
Ū/D
UP/DOWN COUNTER
R̄
ADDRESS CONTROL CIRCUIT
A
D
MEMORY
Pa
DETECTING CIRCUIT
25
26
63
24
MULTICHANNEL ANALOG STEREOPHONIC SIGNAL SOURCE
32
"1"
65
36
37
REVERBERATION CIRCUIT
POWER AMPLIFIER
CONVOLUTION INTEGRATOR
2
3
4
13
50
17
19
21
5
D/A
L
MEMORY
6
15
CORRECTING CIRCUIT
7
51
CONTROL APPARATUS
MULTICHANNEL DIGITAL STEREOPHONIC SIGNAL SOURCE
MEMORY
8
52
CONVERTER
R
1
9
CORRECTING CIRCUIT
MEMORY
10
53
18
20
22
11
12
MEMORY
16
POWER AMPLIFIER
60
14
CONVOLUTION INTEGRATOR
61
SEPARATING CIRCUIT
REVERBERATION CIRCUIT
VIDEO SIGNAL REPRODUCING APPARATUS
62

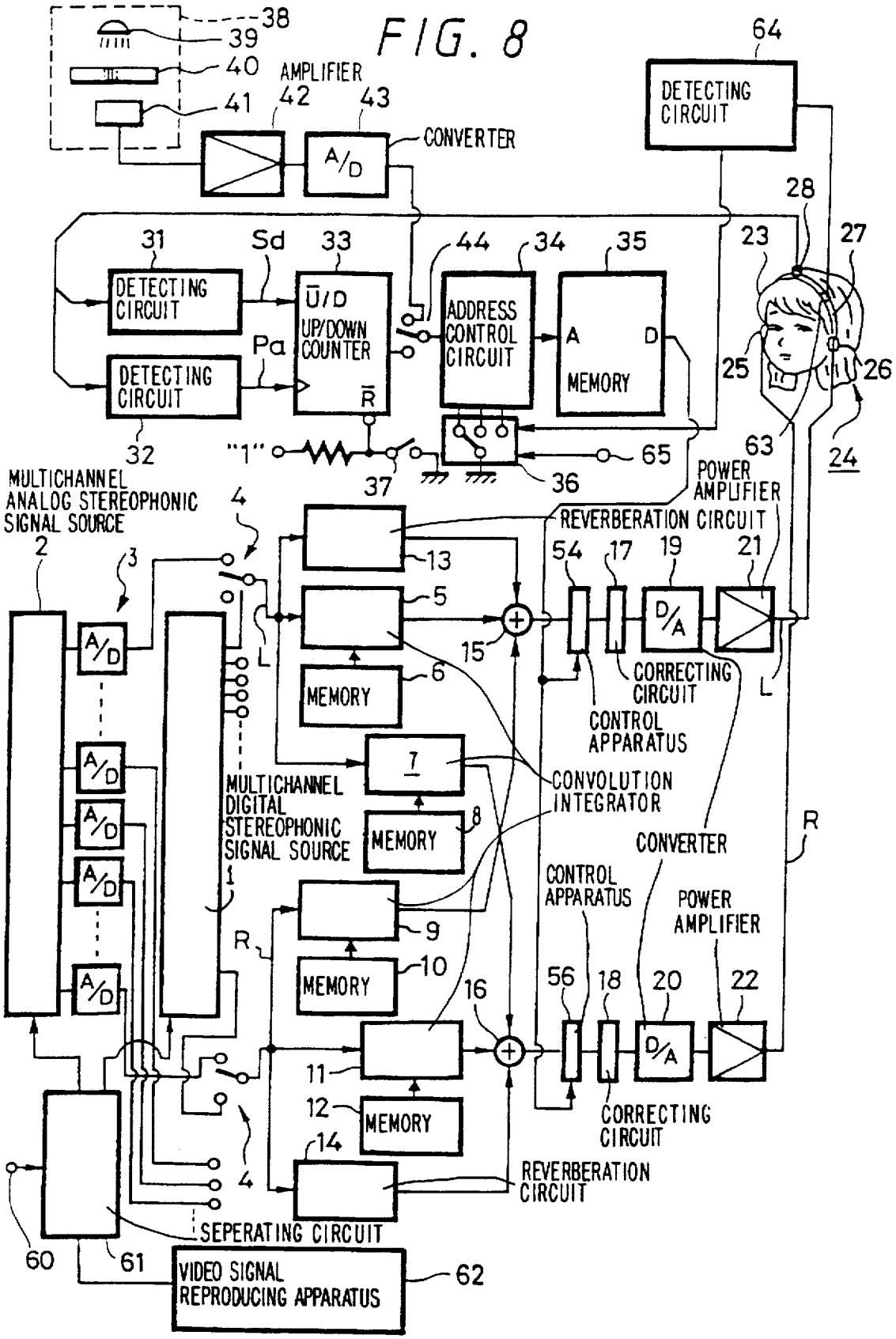
FIG. 8
38
39
40
41
AMPLIFIER
42
43
CONVERTER
A/D
64
DETECTING CIRCUIT
28
27
23
31
Sd
33
44
34
35
DETECTING CIRCUIT
Ū/D
UP/DOWN COUNTER
R̄
Pa
ADDRESS CONTROL CIRCUIT
A
D
MEMORY
25
26
DETECTING CIRCUIT
32
"1"
37
36
65
63
24
MULTICHANNEL ANALOG STEREOPHONIC SIGNAL SOURCE
2
3
4
POWER AMPLIFIER
REVERBERATION CIRCUIT
13
54
17
19
21
5
15
D/A
CORRECTING CIRCUIT
MEMORY
6
L
CONTROL APPARATUS
7
CONVOLUTION INTEGRATOR
MULTICHANNEL DIGITAL STEREOPHONIC SIGNAL SOURCE
MEMORY
8
CONVERTER
R
1
CONTROL APPARATUS
POWER AMPLIFIER
9
R
MEMORY
10
16
56
18
20
22
11
12
MEMORY
CORRECTING CIRCUIT
14
REVERBERATION CIRCUIT
SEPERATING CIRCUIT
60
61
VIDEO SIGNAL REPRODUCING APPARATUS
62

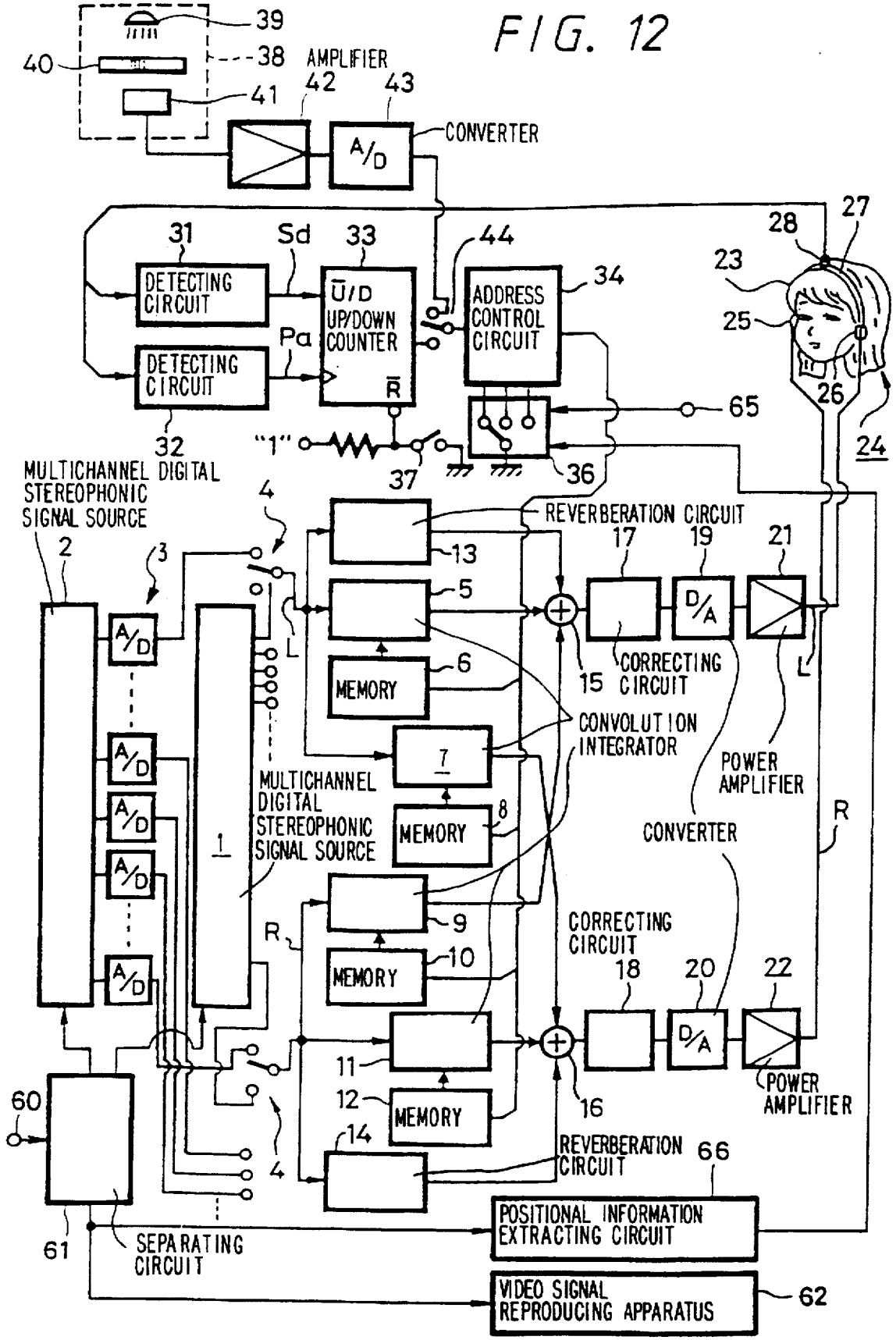
FIG. 12
39
38
40
41
AMPLIFIER
42
43
CONVERTER
A/D
31
Sd
33
44
DETECTING CIRCUIT
Ū/D UP/DOWN COUNTER
R̄
ADDRESS CONTROL CIRCUIT
34
Pa
DETECTING CIRCUIT
32
"1"
37
36
65
28
27
23
25
26
24
MULTICHANNEL STEREOPHONIC SIGNAL SOURCE
2
3
4
REVERBERATION CIRCUIT
13
5
17
19
21
D/A
L
MEMORY
6
15
CORRECTING CIRCUIT
CONVOLUTION INTEGRATOR
7
POWER AMPLIFIER
MULTICHANNEL DIGITAL STEREOPHONIC SIGNAL SOURCE
1
MEMORY
8
CONVERTER
R
9
CORRECTING CIRCUIT
MEMORY
10
18
20
22
11
12
MEMORY
16
POWER AMPLIFIER
60
14
REVERBERATION CIRCUIT
66
POSITIONAL INFORMATION EXTRACTING CIRCUIT
61
SEPARATING CIRCUIT
VIDEO SIGNAL REPRODUCING APPARATUS
62

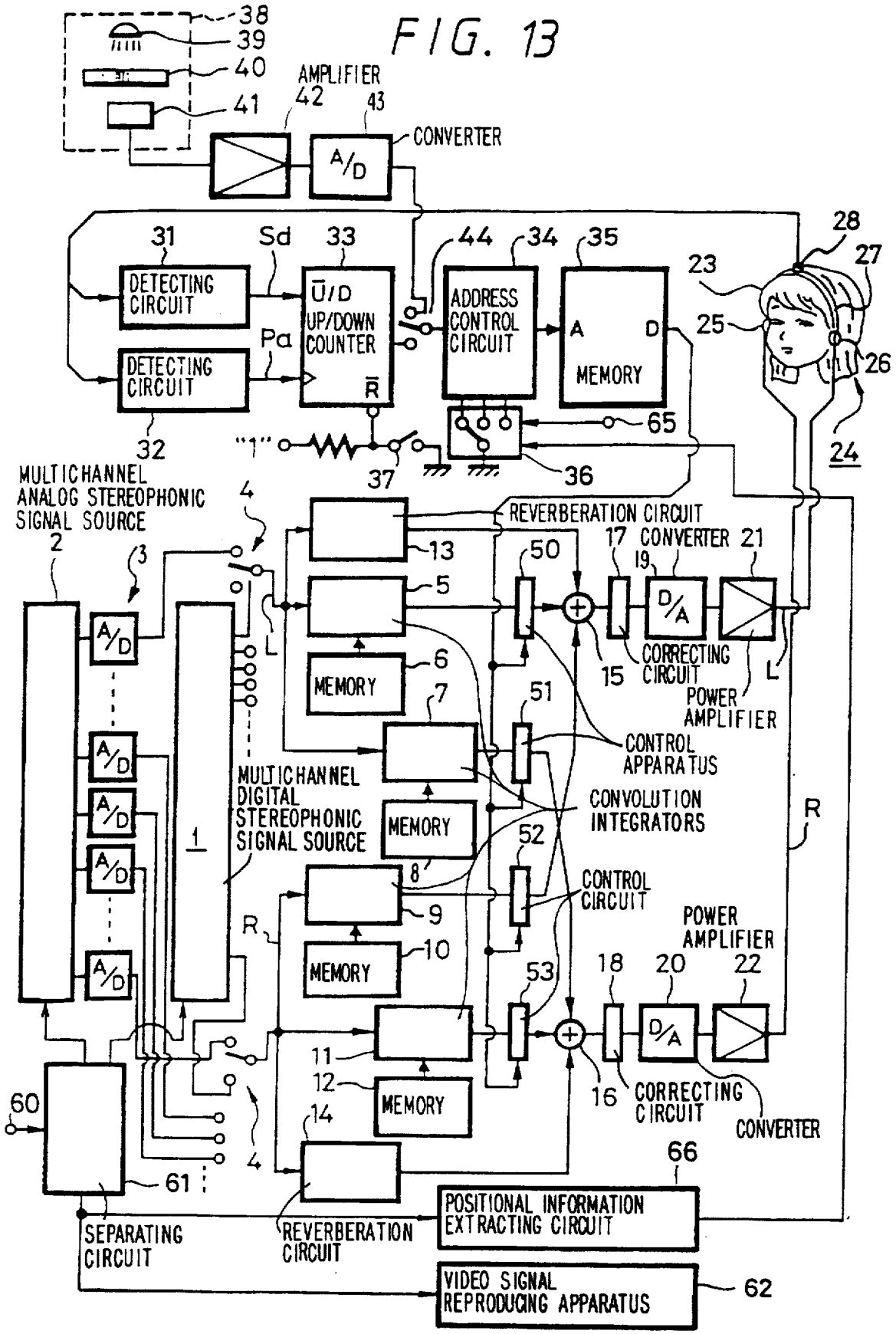
FIG. 13
38
39
40
41
AMPLIFIER
42
43
CONVERTER
A/D
31
Sd
33
44
34
35
28
27
23
25
26
24
DETECTING CIRCUIT
Ū/D
UP/DOWN COUNTER
R̄
ADDRESS CONTROL CIRCUIT
A
D
MEMORY
Pa
DETECTING CIRCUIT
32
"1"
37
36
65
MULTICHANNEL ANALOG STEREOPHONIC SIGNAL SOURCE
2
3
4
REVERBERATION CIRCUIT
13
5
50
17
CONVERTER
19
21
D/A
CORRECTING CIRCUIT
15
POWER AMPLIFIER
L
MEMORY
6
7
51
CONTROL APPARATUS
MULTICHANNEL DIGITAL STEREOPHONIC SIGNAL SOURCE
1
MEMORY
CONVOLUTION INTEGRATORS
52
8
9
CONTROL CIRCUIT
R
MEMORY
10
POWER AMPLIFIER
53
18
20
22
11
12
MEMORY
16
CORRECTING CIRCUIT
CONVERTER
60
14
61
66
POSITIONAL INFORMATION EXTRACTING CIRCUIT
SEPARATING CIRCUIT
REVERBERATION CIRCUIT
VIDEO SIGNAL REPRODUCING APPARATUS
62

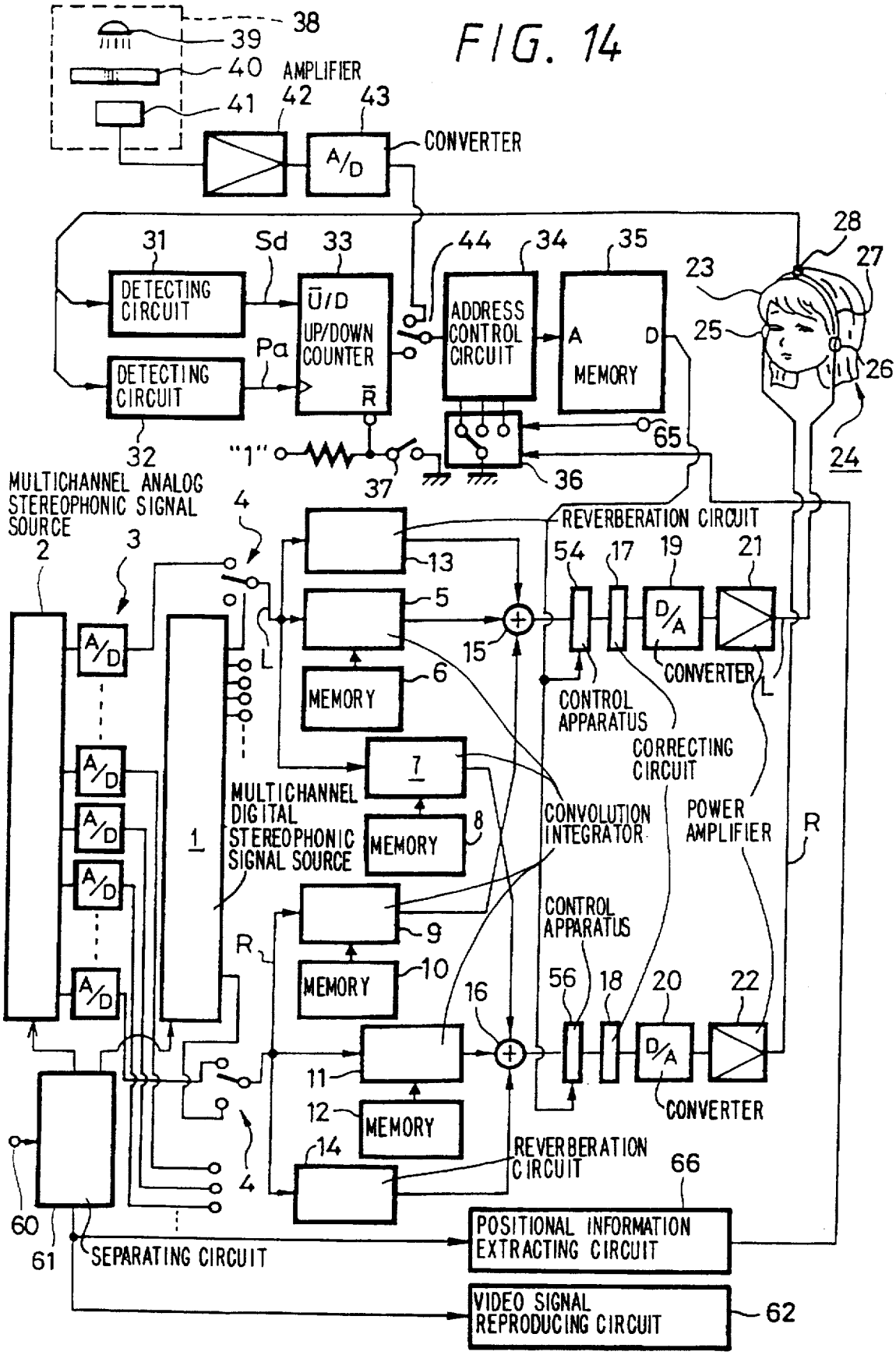
FIG. 14
38
39
40
41
AMPLIFIER
42
43
CONVERTER
A/D
31
Sd
33
44
34
35
28
27
23
25
26
24
DETECTING CIRCUIT
Ū/D
UP/DOWN COUNTER
R̄
Pa
ADDRESS CONTROL CIRCUIT
A
D
MEMORY
DETECTING CIRCUIT
32
"1"
37
36
65
MULTICHANNEL ANALOG STEREOPHONIC SIGNAL SOURCE
2
3
4
REVERBERATION CIRCUIT
13
54
17
19
21
5
15
D/A
CONVERTER
L
MEMORY
6
CONTROL APPARATUS
CORRECTING CIRCUIT
7
MULTICHANNEL DIGITAL STEREOPHONIC SIGNAL SOURCE
1
MEMORY
8
CONVOLUTION INTEGRATOR
POWER AMPLIFIER
R
9
CONTROL APPARATUS
MEMORY
10
16
56
18
20
22
11
12
MEMORY
14
REVERBERATION CIRCUIT
66
60
61
SEPARATING CIRCUIT
POSITIONAL INFORMATION EXTRACTING CIRCUIT
VIDEO SIGNAL REPRODUCING CIRCUIT
62

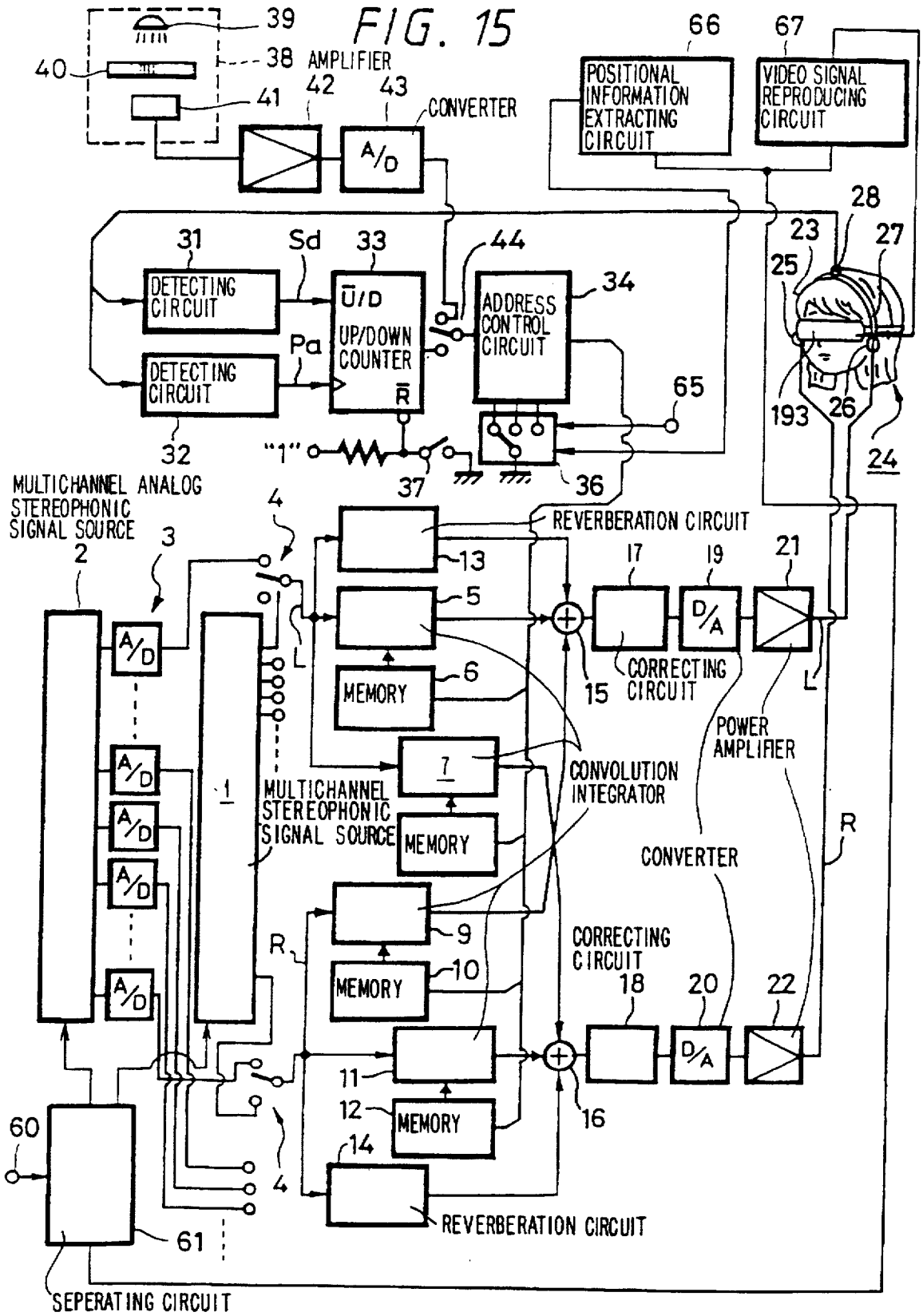
FIG. 15
39
38
AMPLIFIER
40
41
42
43
CONVERTER
A/D
66
POSITIONAL INFORMATION EXTRACTING CIRCUIT
67
VIDEO SIGNAL REPRODUCING CIRCUIT
28
23
27
25
31
Sd
33
44
DETECTING CIRCUIT
Ū/D
UP/DOWN COUNTER
ADDRESS CONTROL CIRCUIT
34
Pa
DETECTING CIRCUIT
R̄
65
193
26
32
"1"
37
36
24
MULTICHANNEL ANALOG STEREOPHONIC SIGNAL SOURCE
4
REVERBERATION CIRCUIT
2
3
13
17
19
21
5
D/A
A/D
L
MEMORY
6
15
CORRECTING CIRCUIT
L
POWER AMPLIFIER
7
CONVOLUTION INTEGRATOR
1
MULTICHANNEL STEREOPHONIC SIGNAL SOURCE
MEMORY
R
CONVERTER
9
R
CORRECTING CIRCUIT
MEMORY
10
18
20
22
11
D/A
12
MEMORY
16
60
14
4
REVERBERATION CIRCUIT
61
SEPERATING CIRCUIT

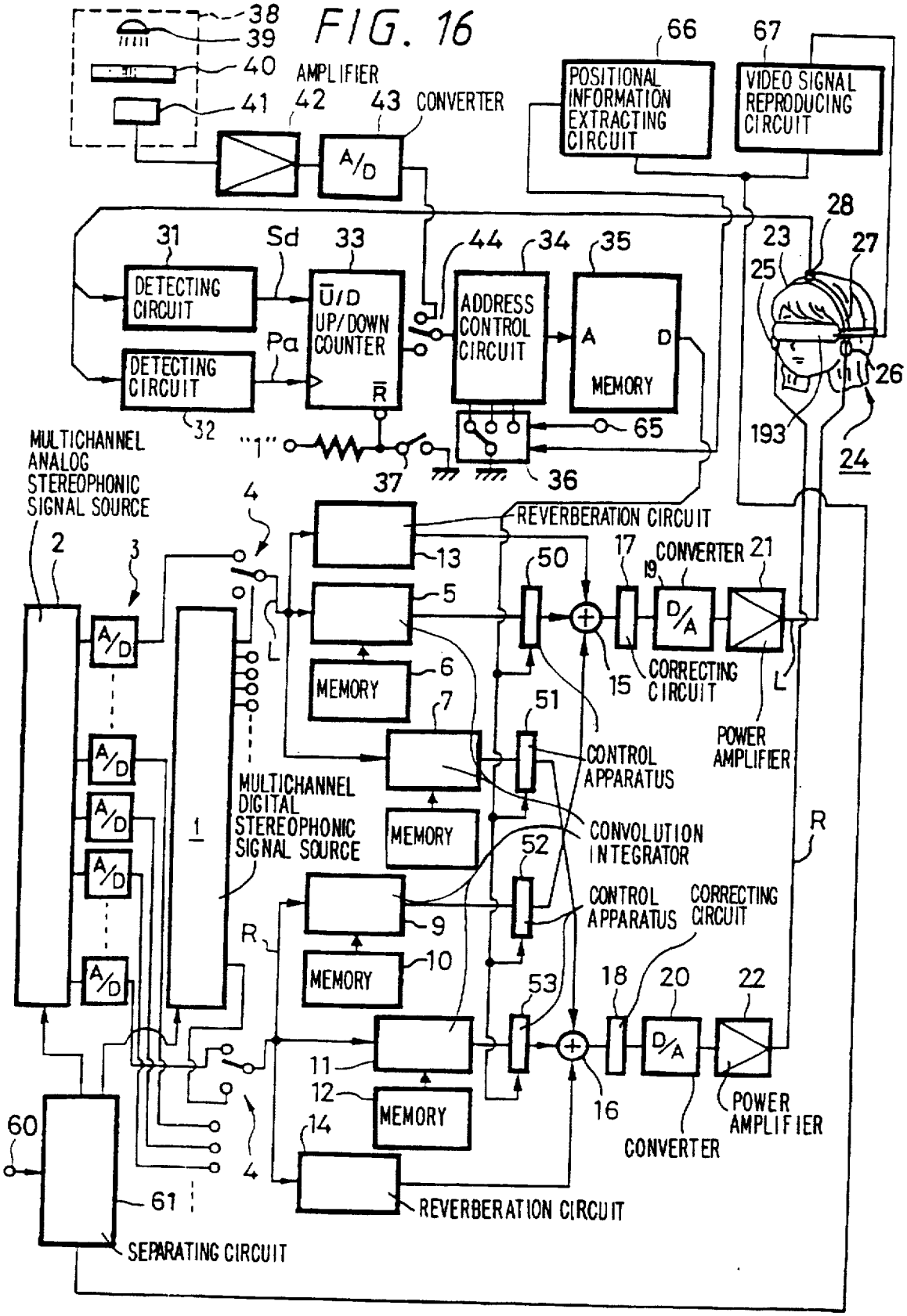
FIG. 16
38
39
40
41
AMPLIFIER
42
43
CONVERTER
A/D
66
POSITIONAL INFORMATION EXTRACTING CIRCUIT
67
VIDEO SIGNAL REPRODUCING CIRCUIT
28
23
27
25
26
24
193
31
Sd
33
44
34
35
DETECTING CIRCUIT
Ū/D UP/DOWN COUNTER
R̄
ADDRESS CONTROL CIRCUIT
A
D
MEMORY
Pa
DETECTING CIRCUIT
32
"1"
37
36
65
MULTICHANNEL ANALOG STEREOPHONIC SIGNAL SOURCE
2
3
4
REVERBERATION CIRCUIT
13
50
17
19
CONVERTER
21
5
D/A
6
MEMORY
15
CORRECTING CIRCUIT
L
7
51
CONTROL APPARATUS
POWER AMPLIFIER
MULTICHANNEL DIGITAL STEREOPHONIC SIGNAL SOURCE
1
MEMORY
CONVOLUTION INTEGRATOR
52
R
9
CONTROL APPARATUS
CORRECTING CIRCUIT
10
MEMORY
53
18
20
22
11
12
MEMORY
16
POWER AMPLIFIER
CONVERTER
60
14
61
REVERBERATION CIRCUIT
SEPARATING CIRCUIT

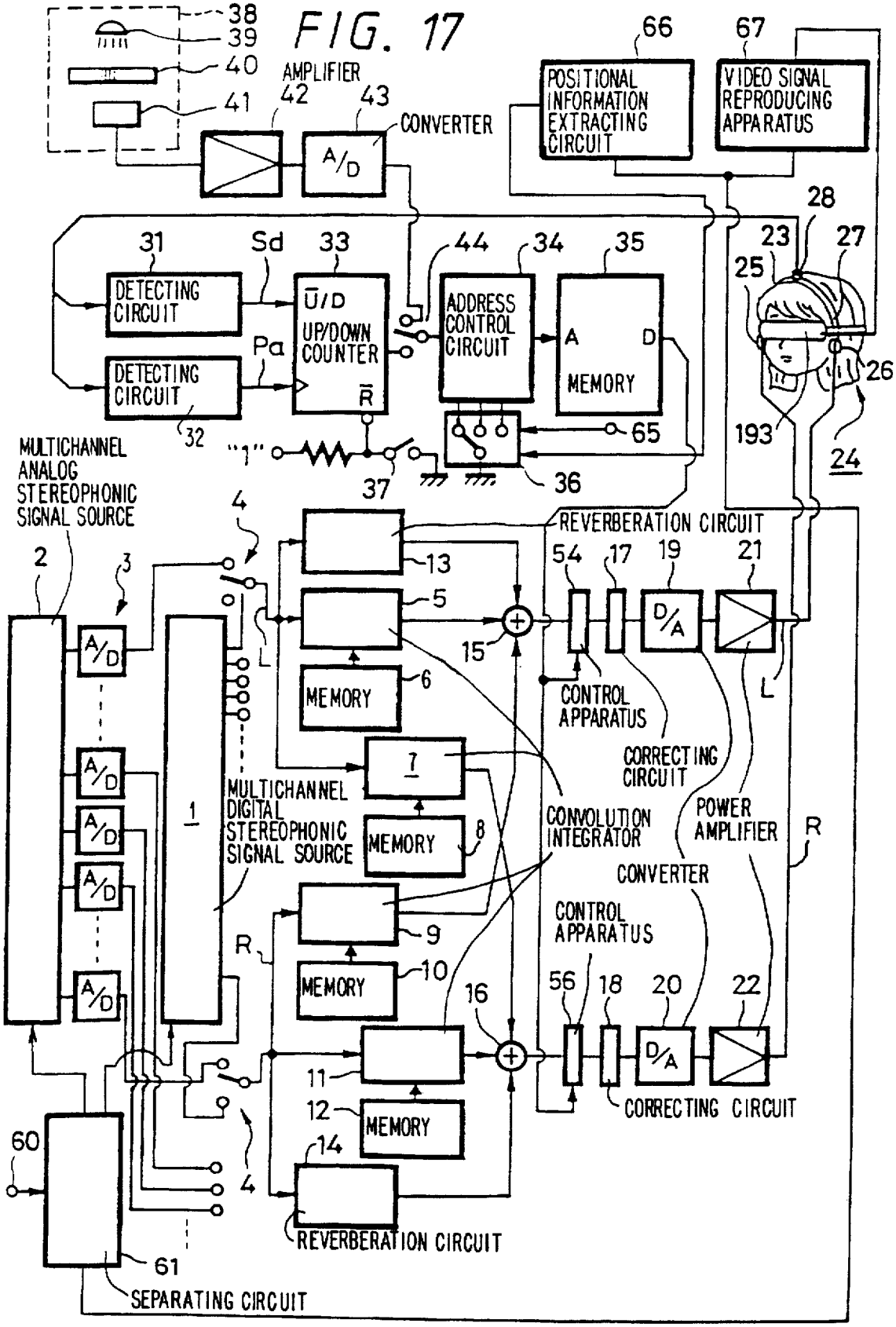
FIG. 17
38
39
40
41
AMPLIFIER
42
43
CONVERTER
A/D
66
POSITIONAL INFORMATION EXTRACTING CIRCUIT
67
VIDEO SIGNAL REPRODUCING APPARATUS
28
23
27
25
26
193
24
31
Sd
33
44
34
35
DETECTING CIRCUIT
Ū/D
UP/DOWN COUNTER
R̄
ADDRESS CONTROL CIRCUIT
A
D
MEMORY
Pa
DETECTING CIRCUIT
32
"1"
37
36
65
MULTICHANNEL ANALOG STEREOPHONIC SIGNAL SOURCE
2
3
4
REVERBERATION CIRCUIT
13
5
15
54
17
19
21
D/A
L
MEMORY
6
CONTROL APPARATUS
CORRECTING CIRCUIT
7
MULTICHANNEL DIGITAL STEREOPHONIC SIGNAL SOURCE
1
MEMORY
8
CONVOLUTION INTEGRATOR
POWER AMPLIFIER
R
CONVERTER
CONTROL APPARATUS
9
MEMORY
10
16
56
18
20
22
11
12
MEMORY
14
CORRECTING CIRCUIT
60
61
REVERBERATION CIRCUIT
SEPARATING CIRCUIT

VIDEO SIGNAL AND AUDIO SIGNAL REPRODUCING APPARATUS

TECHNICAL FIELD

The present invention relates to a video signal and audio signal reproducing apparatus for reproducing an audio signal through headphones while a listener is watching a picture, for example.

BACKGROUND ART

There has conventionally been a method of reproducing an audio signal with using headphones which a listener puts on the head with his both ears covered therewith to listen to the audio signal from the both ears. When the method of reproducing the audio signal through the headphones is employed, there occurs a phenomenon referred to as a so-called lateralization in which a reproduced sound image is perceived inside a head of the listener even if the audio signal from a signal source is a stereophonic signal.

On the other hand, the system of reproducing the audio signal through the headphones includes a binaural sound-wave pickup and reproduction system. The binaural sound-wave pickup and reproduction system is the following system. Microphones, so-called dummy-head microphones, are located in left and right auricles of a dummy head which is made to imitate the listener's head. An audio signal from a signal source is picked up by the dummy-head microphones. When the audio signal thus picked up is reproduced and the listener actually listens to the reproduced audio signal with the headphones, the listener can obtain presence with which the listener feels as if he listened to the sounds directly from the signal source. According to the binaural sound-wave pickup and reproduction system, it is possible to improve the picked-up and reproduced sound image in directivity, localization, presence and so on. However, when the above-mentioned binaural reproduction is carried out, it is necessary to provide a signal source as a special source which is picked up by the dummy-head microphones as a sound source signal and different from that use for reproduction with speakers.

It has been supposed to achieve, by applying the above-mentioned binaural sound-wave pickup and reproduction system, a reproduction effect in which a general stereophonic signal is reproduced through the headphones and a reproduced sound image is localized outside the head (at a speaker position) similarly to the reproduction by the speakers. With this arrangement, when the headphones are used for reproduction, the same effect as the reproduction with the speakers is achieved and an effect in which the reproduced sound is prevented from being leaked to the outside is further achieved due to the headphones. However, when stereophonic reproduction is carried out by using the speakers, even if the listener changes the direction of his head (face), absolute direction and position of a sound image are not changed and only relative direction and position of the sound image the listener perceives are changed. On the other hand, in the case of the binaural reproduction using the headphones, even if the listener changes his head (face), the relative direction and position of the sound image which the listener perceives are not changed. Therefore, even if the binaural reproduction is carried out by using the headphones, then when the listener changes the direction of the head (face), the sound image is formed inside the listener's head. It is particularly difficult to effect a so-called forward localization, i.e., to localize the sound image in front of the listener. Moreover, in this case, the sound image tends to be elevated above the head and hence becomes unnatural.

According to a reproduction method using headphones disclosed in Japanese patent publication No. 42-227, on the contrary the following binaural reproduction system using headphones is supposed. Specifically, directivity and localization of a sound image are determined by difference in volume, time, phase and so on between sounds perceived by left and right ears of the listener. The system disclosed in the above publication has a level control circuit and a variable delay circuit in an audio signal line of each of left and right channels and also has a means for detecting the direction of the listener's head. The level control circuit and the variable delay circuit for the audio signal in each of the channels are controlled based on a signal representing the detected direction of the listener's head.

In the above-mentioned reproduction method using the headphones disclosed in Japanese patent publication No. 42-227, however, a motor is driven by directly using the detection signal representing the direction of the listener's head and a variable resistor and a variable capacitor in the level control circuit and the variable delay circuit are mechanically controlled based on an analog signal by using the motor. Therefore, after the listener has turned the head, a time delay is caused before the differences in volume and time between the audio signals of the respective channels supplied to the headphones are changed. It is impossible for the disclosed reproduction system to sufficiently respond to the movement of the listener's head.

According to the reproduction method using headphones disclosed in Japanese patent publication No. 42-227, characteristics obtained when the differences in volume and time are changed must be determined based on relative positional relationship between a sound source and the listener, a shape of the listener's head, shapes of listener's auricles and so on. Specifically, if a certain characteristic is determined, then the relative positional relationship between the sound source and the listener is fixed so that it is impossible to change a sense of distance and a distance between the sound sources. Further, since listeners have different shapes of heads and auricles, an effect of the method differs depending upon the listeners. Moreover, in the above publication, there is not disclosed means for correcting characteristics inherent in sound sources used when transfer functions from a virtual sound source to the listener's ears is measured and characteristics inherent in the headphones used by the listener. Especially, since the characteristics are changed largely depending on the headphones used, the reproduction state is changed. The above publication does not disclose reproduction of the audio signal corresponding to the video signal.

According to a stereophonic reproduction system disclosed in Japanese patent publication No. 54-19242, a relationship between the listener's direction detected by a gyroscope and change amounts of differences in volume and time between audio signals in both channels which are supplied to the headphones is continuously calculated.

However, the stereophonic reproduction system in the above Japanese patent publication No. 54-19242 requires a memory of a huge capacity for continuously calculating and storing the relationship of the change amounts of the differences in volume and time between the audio signals so that it is very difficult to realize the stereophonic reproduction system. Moreover, in the above publication, there is not disclosed the means for correcting the characteristics inherent in sound sources used when transfer functions from the virtual sound source to the listener's ears is measured and the characteristics inherent in the headphones used by the listener. However, it does not disclose reproduction of the audio signal corresponding to the video signal.

According to an audio reproduction apparatus disclosed in Japanese laid-open patent publication No. 01-112900 filed by the same applicant as the applicant of the present invention, there is provided an apparatus for discretely, not continuously, calculating data of the relationship between the change amounts of the differences in volume and time between audio signals and processing the audio signals.

However, the Japanese laid-open patent publication No. 01-112900 in which the audio reproduction apparatus is disclosed presents only an abstract concept of a principle that can be applied to both analog and digital signal processings and lacks a specific description required when the audio reproduction apparatus effects the analog or digital signal processing and is applied to actual products. Moreover, in the above publication, there is not disclosed the means for correcting the characteristics inherent in sound sources used when transfer functions from a virtual sound source to the listener's ears is measured and the characteristics inherent in the headphones used by the listener. The above publication does not disclose reproduction of the audio signal corresponding to the video signal.

According to an audio-signal reproduction apparatus disclosed in Japanese laid-open patent publication No. 03-214897 filed by the same applicant as the applicant of the present invention, transfer functions from respective virtual sound source positions to listener's ears are fixed and subjected to signal processing and then levels and delay times of signals supplied to the ears are controlled in response to an angle of a head gyration. Therefore, it is possible to simplify an arrangement and save a large memory capacity. The above publication does not disclose reproduction of the audio signal corresponding to the video signal.

Each of the above-mentioned conventional reproduction method using headphones, the stereophonic reproduction system, the audio reproduction apparatus and the audio-signal reproduction apparatus requires a memory having a large memory capacity for a signal processing and hence cannot be embodied without a digital signal processing. However, in each of them, specific signal processing and specific means and method for putting it into a practical use are not disclosed. Therefore, there is then the disadvantage that it is difficult to put each of the systems and apparatus into a practical use.

Each of the above-mentioned conventional reproduction method using headphones, the stereophonic reproduction system, the audio reproduction apparatus and the audio-signal reproduction apparatus is encountered by the disadvantage that it is difficult to localize the reproduced sound image in an optional direction, particularly in front of the listener.

Although a human being perceives the audio signal based on visual information and the visual information influences localization of the sound image, each of the above-mentioned conventional reproduction method using headphones, the stereophonic reproduction system, the audio reproduction apparatus and the audio-signal reproduction apparatus is made to process only the audio signal. There is then the disadvantage that in each of them, reproduction of the audio signal corresponding to the video signal is not described.

DISCLOSURE OF THE INVENTION

In view of such aspects, the present invention is made and a first object thereof is to provide a video signal and audio signal reproducing apparatus which localizes a position of a sound image reproduced from an audio signal such that the sound image corresponds to a picture.

In view of such aspects, the present invention is made and a second object thereof to provide a video signal and audio signal reproducing apparatus which localizes a sound image reproduced from an audio signal such that the sound image corresponds to a virtual sound source.

According to a video signal and audio signal reproducing apparatus of a first invention, an address of a storage means is designated by an address signal generated by an address signal generating means based on a signal supplied from an angle detecting means and corresponding to an angle and an output signal from a detecting means to thereby read out an impulse response or a control signal stored in the storage means. An audio signal is corrected with respect to a relative movement of a listener and a head movement of the listener with respect to a virtual sound source on a video signal reproducing means in a real-time fashion based on the impulse response or the control signal read out from the storage means to thereby correct the audio signal from a signal source such that a plurality of reproduced sound images are localized in the direction corresponding to a picture reproduced by a video signal reproducing means. It is possible to reproduce the audio signal corrected by a control means such that the plurality of reproduced sound images are localized at a position corresponding to the picture reproduced by the video signal reproducing means.

According to a video signal and audio signal reproducing apparatus of a second invention, the detecting means includes an extracting means for extracting positional information output from the signal source together with the video signal and the audio signal and an output signal from the extracting means is supplied to the control means. Therefore, the output signal from the extracting means for extracting the positional information is supplied to the control means. The address of the storage means is designated by the address signal generated by the address signal generating means based on the positional information previously supplied from the signal source together with the video signal and the audio signal to thereby read out the impulse response or the control signal stored in the storage means. The audio signal is corrected with respect to the relative movement of a listener and the head movement of the listener with respect to the virtual sound source of the video signal reproducing means in a real-time fashion based on the impulse response or the control signal read out from the storage means to thereby correct the audio signal from the signal source based on the positional information supplied from the signal source such that a plurality of reproduced sound images are localized in the direction corresponding to the picture reproduced by the video signal reproducing means. It is possible to reproduce the audio signal corrected by the control means such that the plurality of reproduced sound images are localized at the position corresponding to the picture reproduced by the video signal reproducing means.

According to a video signal and audio signal reproducing apparatus of a third invention, the detecting means includes a position detecting means mounted on the listener's head for detecting the relative movement of the listener with respect to the video signal reproducing means and a detection signal from the position detecting means is supplied to the control means. Therefore, the detection signal from the position detecting means for detecting the relative movement of the listener with respect to the video signal reproducing means is supplied to the control means. The address of the storage means is designated by the address signal generated by the address signal generating means based on a signal indicative of a detected relative movement of the listener with respect to the video signal reproducing means to thereby read out the impulse response or the control signal stored in the storage means. The audio signal is corrected with respect to the relative movement of the listener and the head movement of the listener with respect to the virtual sound source of the video signal reproducing means in a real-time fashion based on the impulse response or the control signal read out from the storage means to thereby correct the audio signal from the signal source based on the signal indicative of detected relative movement of the listener with respect to the video signal reproducing means such that a plurality of reproduced sound images are localized in the direction corresponding to the picture reproduced by the video signal reproducing means. It is possible to reproduce the audio signal corrected by the control means such that the plurality of reproduced sound images are localized at the position corresponding to the picture reproduced by the video signal reproducing means.

According to a video signal and audio signal reproducing apparatus of a fourth invention, the position detecting means is provided in an audio signal reproducing means. Therefore, it is easy to detect the relative movement of the listener with respect to the video signal reproducing means. The audio signal from the signal source is corrected based on the signal indicative of the detected relative movement of the listener with respect to the video signal reproducing means such that a plurality of reproduced sound images are localized in the direction corresponding to the picture reproduced by the video signal reproducing means. It is possible to reproduce the audio signal corrected by the control means such that the plurality of reproduced sound images are localized at the position corresponding to the picture reproduced by the video signal reproducing means.

According to a video signal and audio signal reproducing apparatus of a fifth invention, the position detecting means changes coordinates of an angle information from the angle detecting means based on at least information on a head gyration of the listener with respect to the reference direction and information on movement of the listener's head close to or away from the reference position. Therefore, the coordinates of the angle information from the angle detecting means are changed based on at least the information on the head gyration of the listener with respect to the reference direction and the information on the movement of the listener's head close to or away from the reference position. The audio signal from the signal source is corrected such that a plurality of reproduced sound images are localized in the direction corresponding to the reproduced picture. It is possible to reproduce the audio signal corrected by the control means such that the plurality of reproduced sound images are localized at the position corresponding to the picture reproduced by the video signal reproducing means.

According to a video signal and audio signal reproducing apparatus of a sixth invention, the position detecting means adds at least the information on the head gyration of the listener with respect to the reference direction and the information on the movement of the listener's head close to or away from the reference position to the angle information from the angle detecting means to thereby change the angle information from the angle detecting means. Therefore, the information on the head gyration of the listener with respect to the reference direction and the information on the movement of the listener's head close to or away from the reference position are added to the angle information from the angle detecting means to thereby change the coordinates of the angle information from the angle detecting means. The audio signal from the signal source is corrected such that a plurality of reproduced sound images are localized in the direction corresponding to the reproduced picture. It is possible to reproduce the audio signal corrected by the control means such that the plurality of reproduced sound images are localized at the position corresponding to the picture reproduced by the video signal reproducing means.

According to a video signal and audio signal reproducing apparatus of a seventh invention, the angle detecting means includes a reset switch and the angle detecting means sets as the reference direction the direction in which the listener turns the head when the reset switch is turned on. Therefore, the angle detecting means sets as the reference direction the direction in which the listener turns the head when the reset switch is turned on. The address of the storage means is designated, in accordance with the head movement of the listener with respect to the reference direction, by the address signal generated by the address signal generating means based on the signal supplied from the angle detecting means and corresponding to the angle and the output signal from the detecting means to thereby read out the impulse response or the control signal stored in the storage means. The audio signal is corrected with respect to the relative movement of the listener and the head movement of the listener with respect to the virtual sound source of the video signal reproducing means in a real-time fashion based on the impulse response or the control signal read out from the storage means to thereby correct the audio signal from the signal source such that a plurality of reproduced sound images are localized in the direction corresponding to the picture reproduced by the video signal reproducing means. It is possible to reproduce the audio signal corrected by the control means such that the plurality of reproduced sound images are localized at the position corresponding to the picture reproduced by the video signal reproducing means.

According to a video signal and audio signal reproducing apparatus of an eighth invention, when the listener turns the head in the predetermined reference direction, the angle detecting means sets the direction as the reference direction. Therefore, when the listener turns the head in the predetermined reference direction, the direction is set as the reference direction for the angle detecting means. The address of the storage means is designated, in accordance with the head movement of the listener with respect to the reference direction, by the address signal generated by the address signal generating means based on the signal supplied from the angle detecting means and corresponding to the angle and the output signal from the detecting means to thereby read out the impulse response or the control signal stored in the storage means. The audio signal is corrected with respect to the relative movement of the listener and the head movement of the listener with respect to the virtual sound source of the video signal reproducing means in a real-time fashion based on the impulse response or the control signal read out from the storage means to thereby correct the audio signal from the signal source such that a plurality of reproduced sound images are localized in the direction corresponding to the picture reproduced by the video signal reproducing means. It is possible to reproduce the audio signal corrected by the control means such that the plurality of reproduced sound images are localized at the position corresponding to the picture reproduced by the video signal reproducing means.

According to a video signal and audio signal reproducing apparatus of a ninth invention, the audio signal reproducing means includes the reset switch and when the listener wears the audio signal reproducing means, the reset switch is operated and the angle detecting means sets as the reference direction the direction toward a front of a screen of the video signal reproducing means. Therefore, the audio signal reproducing means includes the reset switch and when the listener wears the audio signal reproducing means, the reset switch is operated and the angle detecting means sets as the reference direction the direction toward the front of the screen of the video signal reproducing means. The address of the storage means is designated, in accordance with the head movement of the listener with respect to the reference direction, by the address signal generated by the address signal generating means based on the signal supplied from the angle detecting means and corresponding to the angle and the output signal from the detecting means to thereby read out the impulse response or the control signal stored in the storage means. The audio signal is corrected with respect to the relative movement of the listener and the head movement of the listener with respect to the virtual sound source of the video signal reproducing means in a real-time fashion based on the impulse response or the control signal read out from the storage means to thereby correct the audio signal from the signal source such that a plurality of reproduced sound images are localized in the direction corresponding to the picture reproduced by the video signal reproducing means. It is possible to reproduce the audio signal corrected by the control means such that the plurality of reproduced sound images are localized at the position corresponding to the picture reproduced by the video signal reproducing means.

According to a video signal and audio signal reproducing apparatus of a tenth invention, the apparatus further includes an input means for employing a signal based on a size of a display unit of the video signal reproducing means as data, a signal from the input means is supplied to the address signal generating means, and the address signal generating means generates an address signal in accordance with the signal corresponding to the angle from the angle detecting means, an output signal from the detecting means and data input from the input means. Therefore, the address of the storage means is designated, in accordance with the head movement of the listener with respect to the reference direction, by the address signal, which corresponds to the signal corresponding to the angle from the angle detecting means, the output signal from the detecting means and the data input from the input means and which is generated by the address signal generating means based on the signal corresponding to the angle and supplied from the angle detecting means and the output signal from the detecting means, to thereby read out the impulse response or the control signal stored in the storage means. The audio signal is corrected with respect to the relative movement of the listener and the head movement of the listener with respect to the virtual sound source of the video signal reproducing means in a real-time fashion based on the impulse response or the control signal read out from the storage means to thereby correct the audio signal from the signal source such that a plurality of reproduced sound images are localized in the direction corresponding to the picture reproduced by the video signal reproducing means. It is possible to reproduce the audio signal corrected by the control means such that the plurality of reproduced sound images are localized at the position corresponding to the picture reproduced by the video signal reproducing means.

According to a video signal and audio signal reproducing apparatus of an eleventh invention, the angle detecting means also detects angles of upward and downward gyrations of the listener with respect to the reference direction and the audio signal reproducing means reproduces the audio signal corrected by the control means based on the impulse response or the control signal read out from the storage means in accordance with the angles in the upward and downward directions detected by the angle detecting means, thereby a plurality of optional reproduced sound images being localized in the direction corresponding to the picture reproduced by the video signal reproducing means. Therefore, the address of the storage means is designated, in accordance with the head movement of the listener with respect to the reference direction, by the address signal generated by the address signal generating means based on the signal supplied from the angle detecting means and corresponding to the angle of the upward and downward gyration of the listener with respect to the reference direction and the output signal from the detecting means to thereby read out the impulse response or the control signal stored in the storage means. The audio signal is corrected with respect to the relative movement of the listener and the head movement of the listener with respect to the virtual sound source of the video signal reproducing means in a real-time fashion based on the impulse response or the control signal read out from the storage means to thereby correct the audio signal from the signal source such that a plurality of reproduced sound images are localized in the direction corresponding to the picture reproduced by the video signal reproducing means. It is possible to reproduce the audio signal corrected by the control means such that the plurality of reproduced sound images are localized at the position corresponding to the picture reproduced by the video signal reproducing means.

According to a video signal and audio signal reproducing apparatus of a twelfth invention, the video signal reproducing means can be mounted on the listener's head, is provided so as to be opposed to both eyes of the listener, and projects the reproduced picture on the position distant from the both eyes of the listener by a predetermined distance. Therefore, the address of the storage means is designated by the address signal generated by the address signal generating means based on the signal corresponding to the angle from the angle detecting means. The impulse response or the control signal stored in the storage means is read out therefrom. The audio signal is corrected by the control means based on the impulse response or the control signal to thereby correct the audio signal with respect to the head movement of the listener in a real-time fashion. It is possible for the audio signal reproducing means to reproduce the audio signal corrected by the control means such that a plurality of reproduced sound images are localized in the direction corresponding to the reproduced picture projected on the position distant from left and right eyes of the listener by a predetermined distance when the video signal reproducing means reproduces the video signal.

According to a video signal and audio signal reproducing apparatus a thirteenth invention, the video signal reproducing means includes a head mount body to be mounted on the listener's head and a pair of display units disposed at positions of the head mount body respectively corresponding to listener's both eyes. Therefore, since the video signal reproducing means has a pair of a left display unit and a right display unit disposed at the positions respectively corresponding to the left and right eyes of the listener, it is possible for the left display unit and the right display unit to project the reproduced pictures on the positions distant from the left and right eyes of the listener by a predetermined distance.

According to a video signal and audio signal reproducing apparatus of a fourteenth invention, the video signal reproducing means further includes a pair of rectangular aspheric lenses respectively disposed between the listener's both eyes and the pair of display units. Therefore, since the video signal reproducing means has a pair of a left display unit and a right display unit disposed at the positions corresponding to the left and right eyes of the listener through the left and right rectangular aspheric eyepieces, it is possible to magnify the images projected on the left display unit and the right display unit and to project the reproduced pictures on the positions distant from the left and right eyes of the listener by a predetermined distance in front of the left display unit and the right display unit.

According to a video signal and audio signal reproducing apparatus of a fifteenth invention, the video signal reproducing means includes the head mount body to be mounted on the listener's head and a pair of virtual image display units disposed at the positions of the head mount body respectively corresponding to the listener's both left and right eyes. Therefore, since the video signal reproducing means has a pair of the left virtual image display unit and the right virtual image display unit disposed at the positions of the head mount body respectively corresponding to the listener's eyes, it is possible for the left virtual image display unit and the right virtual image display unit to project the reproduced pictures on the positions distant from the left and right eyes of the listener by a predetermined distance.

According to an audio signal reproducing apparatus of a sixteenth invention, the address of the storage means is designated by the address signal generated by an address signal generating means based on the signal corresponding to the angle from the angle detecting means and the output signal from the detecting means to thereby read out the impulse response or the control signal stored in the storage means. The audio signal is corrected with respect to the relative movement of the listener and the head movement of the listener with respect to the virtual sound source position in a real-time fashion based on the impulse response or the control signal read out from the storage means to thereby correct the audio signal from the signal source such that a plurality of reproduced sound images are localized in the direction to the virtual sound source. It is possible to reproduce the audio signal corrected by the control means such that the plurality of reproduced sound images are localized in the direction to the virtual sound source.

According to an audio signal reproducing apparatus of a seventeenth invention, the detecting means includes the extracting means for extracting positional information output from the signal source together with the audio signal and the output signal from the extracting means is supplied to the control means. Therefore, the output signal from the extracting means for extracting the positional information is supplied to the control means. The address of the storage means is designated by the address signal generated by the address signal generating means based on the positional information previously supplied from the signal source together with the video signal and the audio signal to thereby read out the impulse response or the control signal stored in the storage means. The audio signal is corrected with respect to the relative movement of the listener and the head movement of the listener with respect to the virtual sound source position in a real-time fashion based on the impulse response or the control signal read out from the storage means to thereby correct the audio signal from the signal source based on the positional information supplied from the signal source such that a plurality of reproduced sound images are localized in the direction to the virtual sound source. It is possible to reproduce the audio signal corrected by the control means such that the plurality of reproduced sound images are localized in the direction to the virtual sound source.

According to an audio signal reproducing apparatus of an eighteenth invention, the detecting means includes the position detecting means mounted on the listener's head for detecting the relative movement of the listener with respect to the virtual sound source position and the detection signal from the position detecting means is supplied to the control means. Therefore, the detection signal from the position detecting means for detecting the relative movement of the listener with respect to the virtual sound source position is supplied to the control means. The address of the storage means is designated by the address signal generated by the address signal generating means based on the signal indicative of the detected relative movement of the listener with respect to the virtual sound source position to thereby read out the impulse response or the control signal stored in the storage means. The audio signal is corrected with respect to the relative movement of the listener and the head movement of the listener with respect to the virtual sound source position in a real-time fashion based on the impulse response or the control signal read out from the storage means to thereby correct the audio signal from the signal source based on the signal indicative of the detected relative movement of the listener with respect to the virtual sound source position such that a plurality of reproduced sound images are localized in the direction corresponding to the virtual sound source position. It is possible to reproduce the audio signal corrected by the control means such that the plurality of reproduced sound images are localized at the position corresponding to the virtual sound source position.

According to an audio signal reproducing apparatus of a nineteenth invention, the position detecting means is provided in the audio signal reproducing means. Therefore, it is easy to detect the relative movement of the listener with respect to the virtual sound source position. The audio signal from the signal source is corrected based on the signal indicative of the detected relative movement of the listener with respect to the virtual sound source position such that a plurality of reproduced sound images are localized in the direction corresponding to the virtual sound source position. It is possible to reproduce the audio signal corrected by the control means such that the plurality of reproduced sound images are localized at the position corresponding to the virtual sound source position.

According to an audio signal reproducing apparatus of a twentieth invention, the position detecting means changes the coordinates of the angle information from the angle detecting means based on at least the information on the head gyration of the listener with respect to the reference direction and the information on the movement of the listener's head close to or away from the reference position. Therefore, the coordinates of the angle information from the angle detecting means are changed based on at least the information on the head gyration of the listener with respect to the reference direction and the information on the movement of the listener's head close to or away from the reference position. The audio signal from the signal source is corrected such that a plurality of reproduced sound images are localized in the direction corresponding to the virtual sound source position. It is possible to reproduce the audio signal corrected by the control means such that the plurality of reproduced sound images are localized at the position corresponding to the virtual sound source position.

According to an audio signal reproducing apparatus of a twenty-first invention, the position detecting means adds at least the information on the head gyration of the listener with respect to the reference direction and the information on the movement of the listener's head close to or away from the reference position to the angle information from the angle detecting means to thereby change the angle information from the angle detecting means. Therefore, the information on the head gyration of the listener with respect to the reference direction and the information on the movement of the listener's head close to or away from the reference position are added to the angle information from the angle detecting means to thereby change the coordinates of the angle information from the angle detecting means. The audio signal from the signal source is corrected such that a plurality of reproduced sound images are localized in the direction corresponding to the virtual sound source position. It is possible to reproduce the audio signal corrected by the control means such that the plurality of reproduced sound images are localized at the position corresponding to the virtual sound source position.

According to an audio signal reproducing apparatus of a twenty-second invention, the angle detecting means includes a reset switch and the angle detecting means sets as the reference direction the direction in which the listener turns the head when the reset switch is turned on. Therefore, the angle detecting means sets as the reference direction the direction in which the listener turns the head when the reset switch is turned on. The address of the storage means is designated, in accordance with the head movement of the listener with respect to the reference direction, by the address signal generated by the address signal generating means based on the signal corresponding to the angle from the angle detecting means and the output signal from the detecting means to thereby read out the impulse response or the control signal stored in the storage means. The audio signal is corrected with respect to the relative movement of the listener and the head movement of the listener with respect to the virtual sound source position in a real-time fashion based on the impulse response or the control signal read out from the storage means to thereby correct the audio signal from the signal source such that a plurality of reproduced sound images are localized in the direction corresponding to the virtual sound source position. It is possible to reproduce the audio signal corrected by the control means such that the plurality of reproduced sound images are localized at the position corresponding to the virtual sound source position.

According to an audio signal reproducing apparatus of a twenty-third invention, when the listener turns the head in the predetermined reference direction, the angle detecting means sets that direction as the reference direction. Therefore, when the listener turns the head in the predetermined reference direction, the direction is set as the reference direction by the angle detecting means. The address of the storage means is designated, in accordance with the head movement of the listener with respect to the reference direction, by the address signal generated by the address signal generating means based on the signal corresponding to the angle from the angle detecting means and the output signal from the detecting means to thereby read out the impulse response or the control signal stored in the storage means. The audio signal is corrected with respect to the relative movement of the listener and the head movement of the listener with respect to the virtual sound source position in a real-time fashion based on the impulse response or the control signal read out from the storage means to thereby correct the audio signal from the signal source such that a plurality of reproduced sound images are localized in the direction corresponding to the virtual sound source position. It is possible to reproduce the audio signal corrected by the control means such that the plurality of reproduced sound images are localized at the position corresponding to the virtual sound source position.

According to an audio signal reproducing apparatus of a twenty-fourth invention, the audio signal reproducing means includes the reset switch and when the listener wears the audio signal reproducing means, the reset switch is operated and the angle detecting means sets as the reference direction the direction toward a front of the virtual sound source position. Therefore, the audio signal reproducing means includes the reset switch and when the listener wears the audio signal reproducing means, the reset switch is operated and the angle detecting means sets as the reference direction the direction toward the front of the virtual sound source position. The address of the storage means is designated, in accordance with the head movement of the listener with respect to the reference direction, by the address signal generated by the address signal generating means based on the signal corresponding to the angle from the angle detecting means and the output signal from the detecting means to thereby read out the impulse response or the control signal stored in the storage means. The audio signal is corrected with respect to the relative movement of the listener and the head movement of the listener with respect to the virtual sound source position in a real-time fashion based on the impulse response or the control signal read out from the storage means to thereby correct the audio signal from the signal source such that a plurality of reproduced sound images are localized in the direction corresponding to the virtual sound source position. It is possible to reproduce the audio signal corrected by the control means such that the plurality of reproduced sound images are localized at the position corresponding to the virtual sound source position.

According to an audio signal reproducing apparatus of a twenty-fifth invention, the angle detecting means both detects angles of the upward and downward gyrations of the listener with respect to the reference direction and the audio signal reproducing means reproduces the audio signal corrected by the control means based on the impulse response or the control signal read out from the storage means in accordance with the angles in the upward and downward directions detected by the angle detecting means, thereby a plurality of optional reproduced sound images being localized in the direction corresponding to the virtual sound source position. Therefore, the address of the storage means is designated, in accordance with the head movement of the listener with respect to the reference direction, by the address signal generated by the address signal generating means based on the signal detecting means corresponding to the angle of the upward and downward gyration of the listener with respect to the reference direction from the angle and the output signal from the detecting means to thereby read out the impulse response or the control signal stored in the storage means. The audio signal is corrected with respect to the relative movement of the listener and the head movement of the listener with respect to the virtual sound source position in a real-time fashion based on the impulse response or the control signal read out from the storage means to thereby correct the audio signal from the signal source such that a plurality of reproduced sound images are localized in the direction corresponding to the virtual sound source position. It is possible to reproduce the audio signal corrected by the control means such that the plurality of reproduced sound images are localized at the position corresponding to the virtual sound source position.

According to a video signal and audio signal reproducing apparatus of a twenty-sixth invention, the audio signal from the signal source is corrected by selectively reading out correction data from the storage means based on the information on the angle of the listener's gyration supplied from the angle detecting means. The correction data read out from the storage means based on the information on the angle of the listener's gyration supplied from the angle detecting means are changed based on the detection signal from the detecting means. It is possible to reproduce the audio signal corrected by the control means such that the plurality of reproduced sound images are localized at the position corresponding to the picture reproduced by the video signal reproducing means.

According to a video signal and audio signal reproducing apparatus of a twenty-seventh invention, the storage means, after the impulse response from the virtual sound source position with respect to the reference direction of the listener's head to the both ears corresponding to the head movement of the listener is measured, stores the impulse response, or, after the differences in time and level between the audio signals from the virtual sound source position with respect to the reference direction of the listener's head to the both ears are measured, stores the control signal representing the differences in time and level between the audio signals from the signal source based on measured results. Therefore, the audio signal from the signal source is corrected by selectively reading out the control signal from the storage means based on the information on the angle of the listener's gyration supplied from the angle detecting means. The control signal read out from the storage means based on the information on the angle of the listener's gyration supplied from the angle detecting means is changed based on a detection signal from the detecting means. It is possible to reproduce the audio signal corrected by the control means such that the plurality of reproduced sound images are localized at the position corresponding to the picture reproduced by the video signal reproducing means.

According to a video signal and audio signal reproducing apparatus of a twenty-eighth invention, the apparatus further includes the address signal generating means for generating the address signal supplied to the storage means to read out the impulse response or the control signal stored in the storage means. Therefore, the address signal is supplied from the address signal generating means to the storage means based on the information on the angle of the listener's gyration supplied from the angle detecting means. The audio signal from the signal source is corrected by selectively reading out the impulse response or the control signal from the storage means. The impulse response or the control signal read out from the storage means based on the information on the angle of the listener supplied from the angle detecting means is changed based on a detection signal from the detecting means. It is possible to reproduce the audio signal corrected by the control means such that the plurality of reproduced sound images are localized at the position corresponding to the picture reproduced by the video signal reproducing means.

According to a video signal and audio signal reproducing apparatus of a twenty-ninth invention, the detecting means includes the extracting means for extracting the positional information output from the signal source together with the video signal and the audio signals and the output signal from the extracting means is supplied to the control means. Therefore, the audio signal from the signal source is corrected by selectively reading out the correction data from the storage means based on the information on the angle of the listener's gyration supplied from the angle detecting means. The correction data read out from the storage means based on the information on the angle of the listener's gyration supplied from the angle detecting means are changed based on an output signal from the extracting means for extracting the positional information output together with the video signal and the audio signal from the signal source. It is possible to reproduce the audio signal corrected by the control means such that the plurality of reproduced sound images are localized at the position corresponding to the picture reproduced by the video signal reproducing means.

According to a video signal and audio signal reproducing apparatus of a thirtieth invention, the detecting means includes the position detecting means mounted on the listener's head for detecting the relative movement of the listener with respect to the video signal reproducing means and the detection signal from the position detecting means is supplied to the control means. Therefore, the audio signal from the signal source is corrected by selectively reading out the correction data from the storage means based on the information on the angle of the listener's gyration supplied from the angle detecting means. The correction data read out from the storage means based on the information on the angle of the listener's gyration supplied from the angle detecting means are changed based on the detection signal from the position detecting means mounted on the listener's head for detecting the relative movement of the listener with respect to the video signal reproducing means through the detecting means. It is possible to reproduce the audio signal corrected by the control means such that the plurality of reproduced sound images are localized at the position corresponding to the picture reproduced by the video signal reproducing means.

According to a video signal and audio signal reproducing apparatus of a thirty-first invention, the position detecting means is provided in the audio signal reproducing means. Therefore, the relative movement of the listener with respect to the video signal reproducing means is detected with ease. The audio signal from the signal source is corrected by selectively reading out the correction data from the storage means based on the information on the angle of the listener's gyration supplied from the angle detecting means. The correction data read out from the storage means based on the information on the angle of the listener's gyration supplied from the angle detecting means are changed based on the detection signal from the position detecting means mounted on the listener's head for detecting the relative movement of the listener with respect to the video signal reproducing means through the detecting means. It is possible to reproduce the audio signal corrected by the control means such that the plurality of reproduced sound images are localized at the position corresponding to the picture reproduced by the video signal reproducing means.

BRIEF DESCRIPTION OF DRAWINGS

FIG. 1 is a block diagram showing a video signal and audio signal reproducing apparatus according to an embodiment of the present invention;

FIG. 4 is a diagram showing a table of data of impulse responses of the video signal and audio signal reproducing apparatus according to the embodiment of the present invention;

FIG. 6 is a diagram showing a table data of control data of the video signal and audio signal reproducing apparatus according to the embodiment of the present invention;

FIG. 7 is a block diagram showing a video signal and audio signal reproducing apparatus according to another embodiment of the present invention;

FIG. 8 is a block diagram showing the video signal and audio signal reproducing apparatus according to another embodiment of the present invention;

FIG. 12 is a block diagram showing the video signal and audio signal reproducing apparatus according to another embodiment of the present invention;

FIG. 13 is a block diagram showing the video signal and audio signal reproducing apparatus according to another embodiment of the present invention;

FIG. 14 is a block diagram showing the video signal and audio signal reproducing apparatus according to another embodiment of the present invention;

FIG. 15 is a block diagram showing the video signal and audio signal reproducing apparatus according to another embodiment of the present invention;

FIG. 16 is a block diagram showing the video signal and audio signal reproducing apparatus according to another embodiment of the present invention;

FIG. 17 is a block diagram showing the video signal and audio signal reproducing apparatus according to another embodiment of the present invention;

BEST MODE CARRYING OUT THE INVENTION

Figure 2:
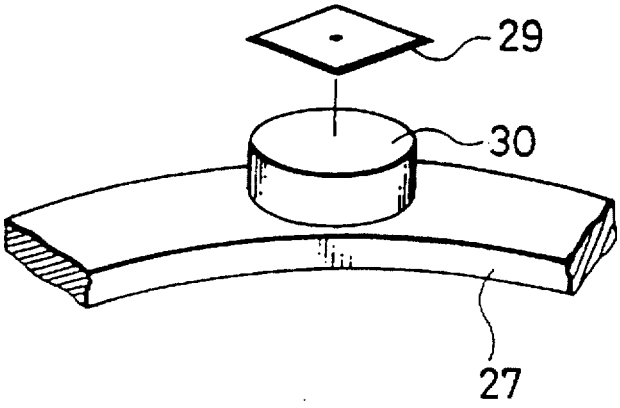
FIG. 2 is a diagram showing an arrangement of a digital angle detector of the video signal and audio signal reproducing apparatus according to the embodiment of the present invention.

A video signal and audio signal reproducing apparatus according to an embodiment of the present invention will hereinafter be described in detail with reference to FIGS. 1 through 11.

According to the video signal and audio signal reproducing apparatus of the embodiment of the present invention, when a video signal and an audio signal having reproduced sound image position information are reproduced through a headphone while a listener watches a picture, the listener can perceive the equivalent localization, sound field and so on to those perceived when the audio signals are reproduced by speakers located in a predetermined positional relationship in which the speakers should be located when the audio signals are reproduced by the speakers. Particularly, a plurality of sound images are located in the direction corresponding to the picture on the basis of the reproduced sound image position information. Moreover, coordinates of the reproduced sound image position information are changed.

Specifically, the video signal and audio signal reproducing apparatus according to the embodiment of the present invention is used in a system of reproducing multichannel video and audio signals, which are obtained by picking up a sound in a stereophonic mode or the like and have the reproduced sound image position information indicating both or either of a microphone position and a sound source position obtained when the sound is picked up, through the headphone while a listener watches the picture. Particularly, when digitized audio signals in respective channels to be recorded or transmitted are reproduced by the headphone or the like, the reproduced sound images in a plurality of channels are localized at the position corresponding to the picture based on the reproduced sound image position information indicating both or either of the microphone position and the sound source position obtained when the sound is picked up. Moreover, the ordinates of the reproduced sound image position information are changed.

FIG. 1 shows an example of the video signal and audio signal reproducing apparatus according to the present invention. The video and audio signals are input from an input terminal 60 to a separating circuit 61. The separating circuit separates the signal into the video signal and the audio signal. The video signal is supplied therefrom to a video signal reproducing apparatus 62.

Reference numeral 1 depicts a multichannel digital stereophonic signal source including a picture, such as a digital audio disc (e.g., an optical video disc), a digital satellite broadcasting or the like. Reference numeral 2 depicts an analog stereophonic signal source, such as an analog record, an analog broadcasting or the like. If the audio signal supplied from the separating circuit 61 is a digital audio signal, then the audio signal is supplied to the digital stereophonic signal source 1. If the audio signal supplied from the separating circuit is an analog audio signal, then it is supplied to the analog stereophonic signal source 2. The digital stereophonic signal source 1 and the analog stereophonic signal source 2 separate the supplied audio signals into two-channel digital and analog audio signals L, R, respectively. Alternatively, the digital stereophonic signal source and the analog stereophonic signal source generate the digital and analog audio signals in four to seven channels, respectively.

Each of the digital and analog audio signals respectively supplied from the digital stereophonic signal source 1 and the analog stereophonic signal source 2 is the audio signal separated from the video signal having the information on the reproduced sound image position. The video signal has the information on the reproduced sound image position indicating both or either of the microphone position and the sound source position when the sound is picked up. Reference numeral 3 depicts A/D converters which convert analog signals into digital signals.

A means for generating the audio signal including the information on the reproduced sound image position indicating both or either of the microphone position and the sound source position obtained when the sound is picked up is a "picking-up and recording system and reproducing system" disclosed in a patent application filed on Nov. 26, 1991 by the same applicant and inventors as those of this application.

Figure 10:
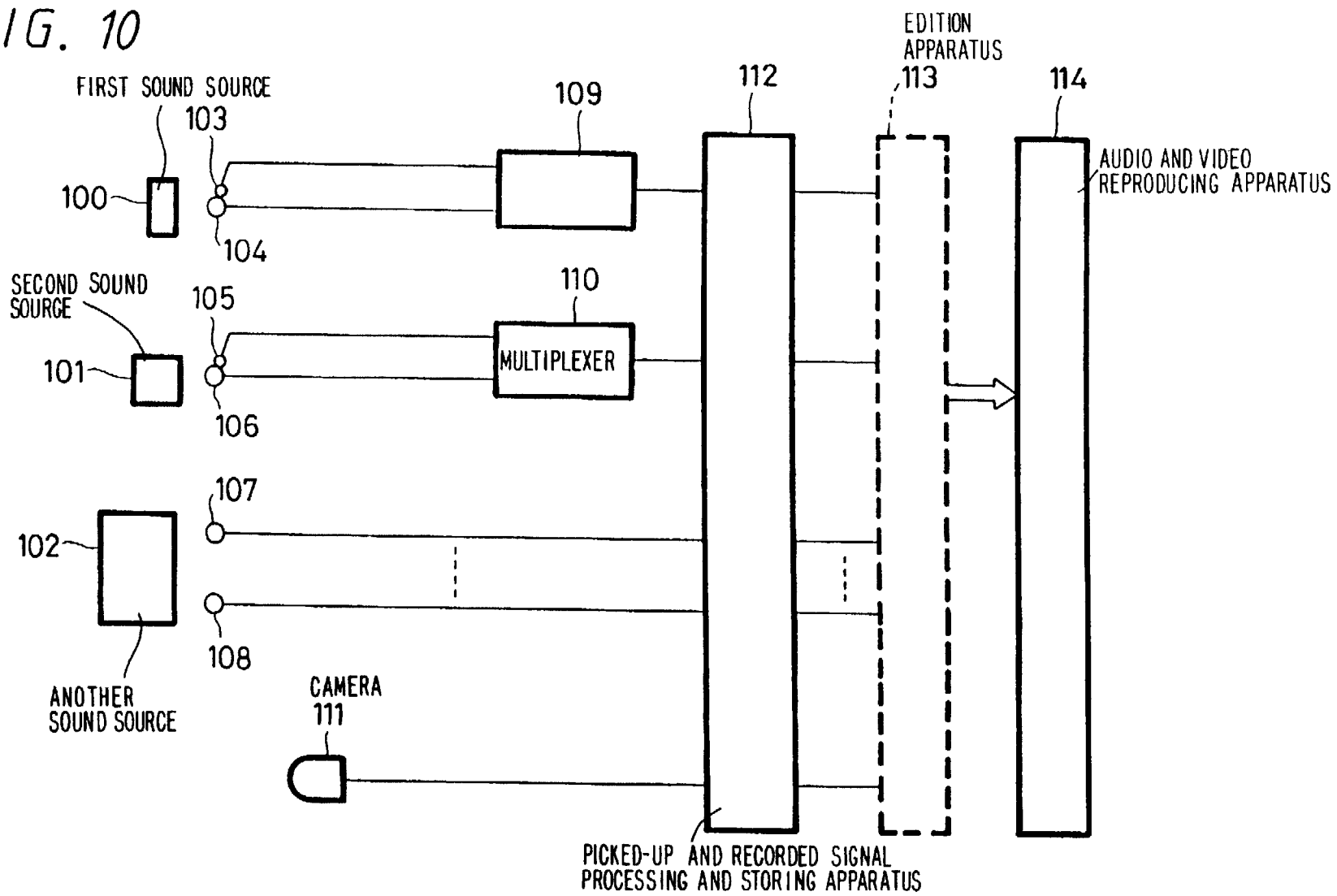
FIG. 10 is a block diagram showing the recording and reproduction of the video signal and the audio signal of the video signal and audio signal reproducing apparatus according to the embodiment of the present invention.

According to an arrangement of the above means, as shown in FIG. 10, the means includes a microphone 104 for picking up a sound from a first sound source 100 and a positional information detecting apparatus 103 for indicating both or either of a position of the microphone 104 and a sound source position of the first sound source 100. The means includes a microphone 106 for picking up a sound from a second sound source 101 and a positional information detecting apparatus 105 for indicating both or either of a position of the microphone 106 and a sound source position of the second sound source 101. Audio signals from the microphones and corresponding position signals are multiplexed by multiplexers 109, 110, respectively. Each of the multiplexers multiplexes and records the corresponding audio signal and the position signal on the same channel. When the audio signal and the position signal are multiplexed, a frequency-division multiplex, a time-division multiplex or other multiplex system may be employed.

Further, microphones 107, 108 for picking up a sound from another sound source 102 are provided. Outputs from the multiplexers 109, 110 and outputs from the microphones 107, 108 are supplied to a picked-up and recorded signal processing and storing apparatus 112. The picked-up and recorded signal processing and storing apparatus 112 records the audio signal and the position signal in the same audio channel with both of the signals being multiplexed.

When the microphones 104, 106, 107 and 108 pick up the sounds, at the same time, a camera 111 picks up an image of a scene including the sound sources 100, 101 and 102. A video signal from the camera is also recorded by the picked-up and recorded signal processing and storing apparatus 112. The respective signals stored in the picked-up and recorded signal processing and storing apparatus 112 are supplied through an editing apparatus 113 to an audio and video reproduction apparatus 114 and reproduced by the latter. Thus, since the position signal is multiplexed together with the corresponding audio signal and both of the signals are recorded in the same channel, it is possible to carry out reproduction corresponding to the position by a reproducing apparatus when the audio signal is reproduced. A real sound image is produced at a sound source position in a reproduced picture. The audio and video reproduction apparatus 114 shown in FIG. 10 corresponds to the video signal and audio signal reproducing apparatus shown in FIG. 1.

It may be arranged that, in FIG. 10, microphones are independently provided for respective, for example, N sound sources whose sounds are to be picked up, and required positional informations on M microphones (where N>M) of the microphones are output into a channel independent of the channels for the audio signal at the same time.

The positional information in this case may be an absolute position information or information on a relative position relative to a predetermined reference position in a sound field. Moreover, the positional information may be not only an orthogonal coordinates system but also a polar coordinates system.

If the analog signals are multichannel analog signals in FIG. 1, then the A/D converters 3 which are as much as the number of the channels of the analog signals are provided. Reference numeral 4 depicts switchers in which both signals inputted as digital signals and signals inputted as analog signals are equally processed as digital signals represented by a constant sampling frequency and a constant number of quantizing bits. While the switchers for two channels are shown here, if the signals are multichannel signals, then the switchers which are as much as the number of channels are provided.

A left digital signal L of the digital signal series is supplied to a convolution integrator 5. At this time, a set of digitally recorded impulse responses are stored in a memory 6 associated with the convolution integrator 5, the digitally recorded impulse responses being impulse responses from a virtual sound source position in the direction in which a listener 23 turns the head at present with respect to a reference direction of the head to the both ears of the listener and being represented by a constant sampling frequency and a constant number of quantizing bits. The digital signal series are subjected to convolution integral together with the impulse response read out from the memory 6 by the convolution integrator 5 in a real-time fashion. A convolution integrator 7 and a memory 8 supply a crosstalk component of a right digital signal R.

Similarly to the left digital signal, the right digital signal R is supplied to a convolution integrator 11. At this time, a set of digitally recorded impulse responses are stored in a memory 12 associated with the convolution integrator 11, the digitally recorded impulse responses being impulse responses from the virtual sound source position in the direction in which the listener 23 turns the head at present with respect to the reference direction of the head to both the ears of the listener and being represented by the constant sampling frequency and the constant number of quantizing bits. The digital signal series are subjected to convolution integral together with the impulse response read out from the memory 12 by the convolution integrator 11 in a real-time fashion. A convolution integrator 9 and a memory 10 supply a crosstalk component of a right digital signal L.

Similarly, the convolution integrator 7 and the memory 8 and the convolution integrator 11 and the memory 12 subject the digital signals to the convolution integral together with the impulse responses. As described above, the digital signal series subjected by the convolution integrators 5, 7, 9 and 11 and the memories 6, 8, 10 and 12 to the convolution integral together with the impulse responses are supplied to adders 15, 16, respectively. Two-channel digital signals added by the adders 15, 16 are corrected by correcting circuits 17, 18 to remove therefrom characteristics inherent in sound sources and a headphone which are used, and then converted by D/A converters 19, 20 into two-channel analog signals. The two-channel analog signals are amplified by power amplifiers 21, 22 and then supplied to a headphone 24.

While the impulse responses are stored in memories 6, 8, 10 and 12 in the above embodiment, an arrangement shown in FIG. 7 may be employed. FIG. 7 shows only a processing of the audio signal. A processing of the video signal in the arrangement is the same as that shown in FIG. 1 and hence will not be described. Specifically, a pair of digitally recorded impulse responses from the virtual sound source positions in the head direction fixed with respect to the reference direction to the listener's both ears are stored in the memories 6, 8, 10 and 12 associated with the convolution integrators 5, 7, 9 and 11. The digital signal series are subjected to the convolution integral together with the impulse responses in a real-time fashion. The memory 35 stores a control signal representing differences in time and level between sounds obtained at the both ears from the virtual sound source positions with respect to the reference direction of the head to the both ears.

A newly detected head movement with respect to the reference direction is converted into a digital address signal representing a magnitude of the head movement including its direction at every constant unit angle or every predetermined angle. The control signal previously stored in the memory 35 is read out therefrom based on the digital address signal. The digital signals in the respective channels subjected to the convolution integral are corrected and changed by control apparatus 50, 51, 52 and 53 in a real-time fashion and results thereof are supplied to the adders 15, 16.

An arrangement shown in FIG. 8 may be employed. Specifically, the digital signal series subjected to the convolution integral together with the impulse responses in a real-time fashion are supplied to the address 15, 16. A newly detected head movement with respect to the reference direction is converted into a digital address signal representing a magnitude of the head movement including its direction at every constant unit angle or every predetermined angle. The control signal previously stored in the memory 35 is read out therefrom based on the digital address signal. The two-channel digital signals supplied from the adders 15, 16 are corrected and changed by control apparatus 54, 56 in a real-time fashion. FIG. 8 shows only the processing of the audio signal. The processing of the video signal in this arrangement is the same as that shown in FIG. 1 and hence will not be described.

In the arrangements shown in FIGS. 7 and 8, each of the control apparatus 50, 51, 52, 53, 54 and 56 may be formed by combining a variable delay apparatus and a variable level controller or a level controller for controlling a level in every frequency band, such as a graphic equalizer having a number of divided bands or the like. Information stored in the memory 35 may be impulse response representing difference in time, level and so on between sounds obtained at the both ears from the virtual sound source positions in the direction in which the listener 23 turns the head with respect to the reference direction of the head to the both ears. In this case, each of the above-mentioned control apparatus may be formed of an IIR or FIR variable digital filter. Thus, the above-mentioned control apparatus give spatial information to the digital signals.

In the arrangements shown in FIGS. 1, 7 and 8, the digital signals are corrected by the correcting circuits 17, 18 with respect to the characteristics inherent in the sound sources and the headphone which are used, changed by the correcting circuits 17, 18 in response to the head movement, and then converted by the D/A converters 19, 20 into the analog signals. The analog signals are amplified by the power amplifiers 21, 22 and then supplied to the headphone 24.

In this case, the correcting circuits 17, 18 for correcting the characteristics inherent in the sound sources and the headphone to be used may process signals in an analog or digital fashion. If the headphones is of wireless type, then the correcting circuits 17, 18 may be provided in a main body of the headphone. The correcting circuits 17, 18 may not necessarily be housed in the main body of the headphone, but may be provided in cords of the headphone, for example, or may be provided in connector units for connecting the apparatus main body and the headphone or a subsequent stage. Moreover, the correcting circuits 17, 18 may be provided in the control apparatus of the apparatus main body or a subsequent stage.

A digital angle detector 28 detects a head movement of the listener 23. FIG. 2 shows a detailed arrangement of the digital angle detector 28. FIG. 2 shows the digital angle detector 28 using horizontal component forces of geomagnetism. In the arrangement shown in FIG. 2, a signal indicative of a detected angle is output in the form of a digital signal.

In order to detect the head movement of the listener 23 with respect to the reference direction at every constant unit angle or at every predetermined angle as discrete information, a rotary encoder 30 is provided at a center position of the head with an input shaft thereof being vertical and a magnetic needle 29 is provided at the input shaft thereof. Accordingly, the rotary encoder 30 outputs a signal indicative of the head movement of the listener 23 including the direction with reference to the north and south direction indicated by the magnetic needle 29. While the rotary encoder is attached to a head band 27 of the headphone 24, the rotary encoder 30 may be attached to an attachment device provided independently of the head band 27.

As shown in FIG. 1, the output from the rotary encoder 30 of the digital angle detector 28 is supplied to detecting circuits 31, 32. The detecting circuit 31 outputs a direction signal Sd and is set to "0" or "1" when the listener 23 turns the head in the clockwise direction or in the counterclockwise direction. The detecting circuit 32 outputs pulses Pa of the number proportional to an angle changed when the listener 23 changes the head direction, i.e., one pulse Pa each time when the angle of the head of the listener is changed by each 2°.

The signal Sd is supplied to a count direction input terminal U/D of an up/down counter 33, and the pulse Pa is supplied to a clock input (count input) terminal CK of the up/down counter 33. A count output of the up/down counter is converted to a digital address signal indicating the direction and magnitude of the head movement of listener 23. The digital address signal is supplied through an address control circuit 34 to the memories 6, 8, 10 and 12 as an address signal.

The impulse responses, which are previously digitally recorded in the memories 6, 8, 10 and 12, from the virtual sound source positions with respect to the reference direction of the head of the listener 23 to the both ears of the listener 23 are read from corresponding addresses of the tables of the memories 6, 8, 10 and 12. At the same time, the impulse responses are subjected by the convolutional integrators 5, 7, 9 and 11 to convolution integral together with the digitized audio signals in the respective channels. Thus, the digitized audio signals are corrected in a real-time fashion with respect to the direction in which the listener 23 turns the head at present.

Figure 3:
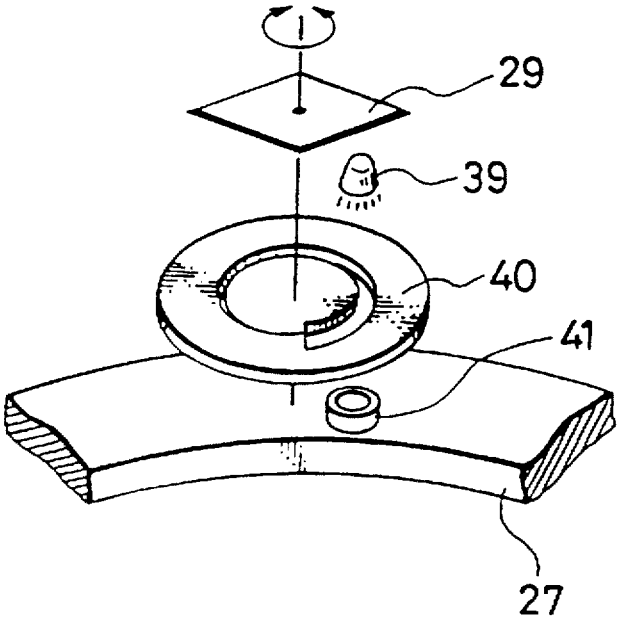
FIG. 3 is a diagram showing an arrangement of an analog angle detector of the video signal and audio signal reproducing apparatus according to the embodiment of the present invention.

On the other hand, reference numeral 38 depicts an analog angle detector. FIG. 3 shows an arrangement of the analog angle detector in detail. In the arrangement shown in FIG. 3, an output signal indicative of a detected angle is output as an analog signal. A photosensor 41 composed of a photosensor element, such as a CDS, a photodiode or the like whose resistance value changes in response to light intensity is disposed on the center portion of the head of the listener 23. A light emitter 39, such as a bulb, a light emitting diode or the like, is disposed so as to be opposed to the photosensor 41. The light emitter 39 radiates light of predetermined intensity on the photosensor 41.

In the light path of light radiated from the light emitter 39, there is provided a movable shutter 40 whose transmittance for the radiated light is changed depending upon a rotational angle thereof. The movable shutter 40 is rotated together with the magnetic needle 29. Accordingly, when a constant current flows into the photosensor 41, a voltage across both ends of the photosensor of the photosensor 41 is derived as an analog output representing the head movement of the listener 23 including its direction with reference to the north and south direction indicated by the magnetic needle 29. While the analog angle detector 38 is attached to the head band 27 of the headphone 24 in this embodiment, the analog angle detector may be attached onto an attachment device provided independently of the head band 27.

In FIG. 1, the analog output from the analog angle detector 38 is amplified by an amplifier 42 and then added to an A/D converter 43. A digital output therefrom is supplied through a switcher 44 to the address control circuit 34. The address control circuit 34 generates a digital address signal representing a magnitude of the head movement of the listener 23 with respect to the reference direction including the direction thereof at every constant angle or every predetermined angle.

In FIG. 1, the impulse responses, which are previously digitally recorded in the memories 6, 8, 10 and 12, from the virtual sound source positions with respect to the reference direction of the head of the listener 23 to the both ears of the listener 23 are read from corresponding addresses of the tables of the memories 6, 8, 10 and 12. The impulse responses are subjected to convolution integral together with the digitized audio signals in respective channels by the convolution integrators 5, 7, 9 and 11. Thus, the digital signals are corrected in a real-time fashion with respect to the direction in which the listener 23 turns the head at present.

In FIG. 7, the control signals, which are previously digitally recorded in the memory 35, representing differences in time, level and so on between sounds obtained at the ears from the virtual sound source positions with respect to the reference direction of the head of the listener 23 to the both ears of the listener 23 are read from corresponding addresses of the table of the memory 35. Based on the control signals, the digitized audio signals in respective channels subjected to convolution integral together with the impulse responses by the convolution integrators 5, 7, 9 and 11 and the memories 6, 8, 10 and 12 associated respectively therewith are corrected by the control apparatus 50, 51, 52 and 53 in a real-time fashion with respect to the direction in which the listener 23 turns the head at present. In FIG. 8, in response to the control signals, the two-channel digital signals added by the adders 15, 16 are corrected by the control apparatus 54, 56 in a real-time fashion with respect to the direction in which the listener 23 turns the head at present. In this case, the control signal is the same as that used in the arrangement shown in FIG. 7.

Figure 5:
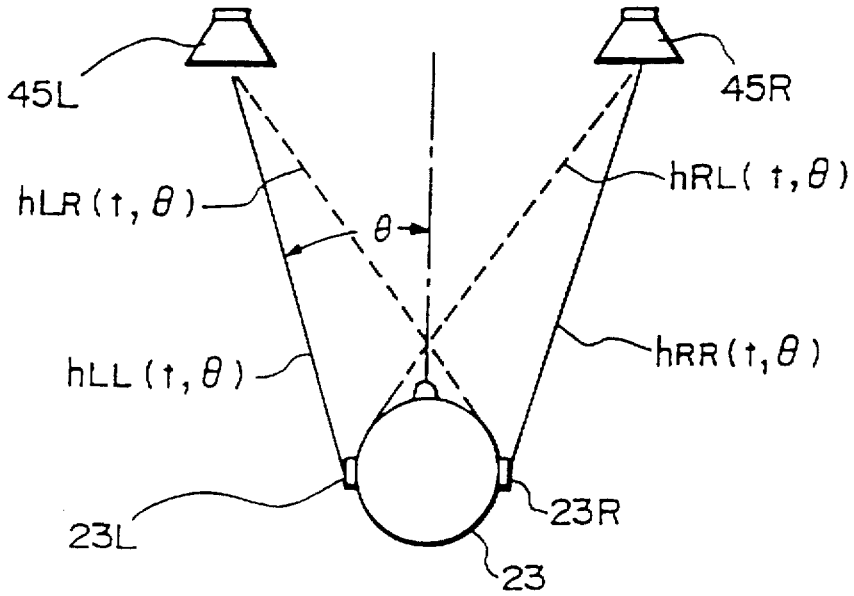
FIG. 5 is a diagram used to explain measurement of the impulse responses of the video signal and audio signal reproducing apparatus according to the embodiment of the present invention.

FIG. 4 shows a table data stored in the memories 6, 8, 10 and 12. Specifically, when front left and right speakers 45L, 45R are positioned in front of the listener 23 as shown in FIG. 5, if the impulse responses from positions of the left and right speakers 45L, 45R to the both ears of the listener 23 are represented by Equation 1

$$h_{LL}(t,\theta) = 1/2\pi \int_{-\infty}^{\infty} H_{LL}(\omega,\theta) \cdot \exp(j\omega t) d\omega$$

Equation 2

$$h_{LR}(t,\theta) = 1/2\pi \int_{-\infty}^{\infty} H_{LR}(\omega,\theta) \cdot \exp(j\omega t) d\omega$$

Equation 3

$$h_{RL}(t,\theta) = 1/2\pi \int_{-\infty}^{\infty} H_{RL}(\omega,\theta) \cdot \exp(j\omega t) d\omega$$

Equation 4

$$h_{RR}(t,\theta) = 1/2\pi \int_{-\infty}^{\infty} H_{RR}(\omega,\theta) \cdot \exp(j\omega t) d\omega,$$

then the impulse responses representing the above equations are digitally recorded in the memories 6, 8, 10 and 12.

In the above table, reference symbol $h_{mn}(t)$ depicts impulse response from a speaker position m to an ear n, reference symbol $H_{mn}(\omega)$ depicts transfer function from the speaker position m to the ear n, reference symbol $\omega$ depicts an angular frequency of $2\pi f$, and reference symbol f depicts a frequency.

FIG. 6 shows an example of control data of the control signals stored in the table in the memory 35. The control data are supplied to the control apparatus shown in FIGS. 7 and 8. Specifically, the difference in time between the sounds respectively obtained at the both ears, $\Delta T_{IJ}(\theta)$, and difference in level between the sounds respectively obtained at the both ears, $\Delta L_{IJ}(\theta)$, are recorded in the table of the control signals stored in the memory 35 (where IJ=LL, LR, RL, RR, . . . ). These control signals are supplied to the above-mentioned control apparatus 50 through 54 and 56.

Each of the control apparatus 50 through 54 and 56 may be formed by combining the variable delay apparatus and the variable level controller or the level controller for controlling the level in every frequency band, such as the graphic equalizer having a number of divided bands or the like. Information stored in the memory 35 may be impulse response representing differences in time, level and so on between sounds obtained at the both ears from the virtual sound source positions in the direction in which the listener 23 turns the head with respect to the reference direction of the head to both the ears. Contents stored in the memory 35 have data structure corresponding to the control apparatus 50 through 54 and 56. In this case, each of the above-mentioned control apparatus 50 through 54 and 56 may be formed of an IIR or FIR variable digital filter.

The speakers may be used as the sound sources used for measuring the control signals representing the difference in time between the sounds obtained at the respective ears and the difference in level therebetween. Positions where sound waves are picked up in the respective ears of the listener 23 may be anywhere from the inlets of the external auditory canals thereof to the ear drums thereof.

However, the positions should be equal to positions used to calculate characteristics of correction for canceling the characteristics inherent in the headphone to be used.

On the assumption of the above-mentioned impulse responses, each of the digitally recorded impulse responses obtained when an angle θ is changed by a unit angle, e.g., 2° is written in an address of the table of the memory 35. The unit angle is set to be every angle through which the listener 23 can perceive with the left and right ears that he turns the head.

A position detector 63 for detecting a relative position, such as a distance between a screen of the video signal reproducing apparatus 62 and the listener 23, an angle made by the listener and the screen or the like, is provided on the head band 27 of the headphone 24. The position detector 63 may be three three-dimensionally disposed detection coils for detecting a leakage magnetic flux from the screen of the video signal reproducing apparatus 62, a velocity or acceleration pickup or the like. When the positional information is detected, a method of employing an output of a gyroscope for detecting a three-dimensional position with reference to a reference position, a method of employing an electric wave from a satellite (GPS) or the like and a method of measuring distances from a plurality of ultrasonic wave sources may be employed.

The position detector 63 supplies a signal indicative of a detected position to a detecting circuit 64. Based on the signal indicative of the detected position, the detecting circuit 64 supplies a control signal used to switch an address of the address control circuit 34 to a switcher 36. A switch signal based on a screen size of the screen of the video signal reproducing apparatus 62 is supplied through an input terminal 65 to the switcher 36.

The memory 35 includes three sets of such tables, each of sets having different data values depending upon a relative positional relationship such as a distance between the screen of the video signal reproducing apparatus 62 and the listener 23, an angle made thereby or the like, the screen size of the screen of the video signal reproducing apparatus 62 and so on. An optimum set of the three sets of tables is selected by switching an address of the address control circuit 34 by switching the switcher 36 thereof.

In FIGS. 1, 7 and 8, reference numeral 37 depicts a center reset switch. When the center reset switch is turned on, values of the up/down counter 33 are reset to "all 0". At this time, an address θ=0 is selected in the tables of the memories 6, 8, 10, 12 and 35. Specifically, when the center reset switch 37 is turned on, the direction in which the listener 23 turns the head at present is set to be the front direction toward the sound sources.

The video signal and audio signal reproducing apparatus according to the embodiment are arranged as described above and operates as follows. Specifically, the video signal and the audio signal are input from the input terminal 60. The separating circuit 61 separates the input signals into the video signal and the audio signal. The video signal is supplied therefrom to the video signal reproducing apparatus 62. If the audio signal separated by the separating circuit 61 is the digital audio signal, then it is supplied to the digital stereophonic signal source 1, and if it is the analog audio signal, then it is supplied to the analog signal source 2. The digital audio signals from the multichannel digital stereophonic signal source 1 or the audio signals in respective channels obtained by converting the analog audio signals input to the multichannel analog stereophonic signal source 2 into the digital signals by the A/D converters 3 are selected by the switchers 4.

In this case, both the digital audio signals and the analog audio signals are the audio signals separated from the video signals, respectively. The audio signals have the information on the reproduced sound image position indicating both or either of the microphone position and the sound source position obtained when the sound is picked up. In the arrangement shown in FIG. 1, the digital signal series, together with the impulse responses read out from the memories 6, 8, 10 and 12, are subjected to convolution integral by the convolution integrators 5, 7, 9 and 11 in a real-time fashion, and then supplied to the adders 15, 16. In the arrangements shown in FIGS. 7 and 8, the same processings are carried out.

In the arrangement shown in FIG. 7, the digitized audio signals in respective channels previously subjected to convolution integral with the impulse responses by the convolution integrators 5, 7, 9 and 11 and the memories 6, 8, 10 and 12 are corrected and changed by the control apparatus 50, 51, 52 and 53 based on the control signals read from the memory 35, and supplied to the adders 15, 16.

In the arrangement shown in FIG. 8, the two-channel digital signals from the adders 15, 16 are corrected and changed by the control apparatus 54, 56 based on the control signals read from the memory 35. The two-channel digital signals are converted by the D/A converters 19, 20 into the analog signals which are amplified by the power amplifiers 21, 22 and then supplied to the headphones 24.

Thus, the listener 23 wearing the headphone 24 can listen to sounds reproduced from the audio signals. The movement of the head of the listener 23 with respect to the reference direction at every constant or predetermined angle is detected by the digital angle detector 28 and the analog angle detector 38 and converted by the address control circuit 34 into the digital address signal representing the magnitude of the movement including its direction.

The digitally recorded impulse responses or control signals from the virtual sound source positions with respect to the reference direction of the head to both the ears are read out from the memory 35 in response to the digital address signal. The convolution integrators 5, 7, 9 and 11 and the memories 6, 8, 10 and 12 or the control apparatus 50, 51, 52, 53, 54 and 56 correct and change the audio signals based on the impulse responses or the control signals in a real-time fashion.

The signals are converted by the convolution integrators 5, 7, 9 and 11, the memories 6, 8, 10 and 12 or the control apparatus 50, 51, 52, 53, 54 and 56 and the address 15, 16 into the two-channel digital signals which have spatial information representing the sound field and are supplied to both the ears. The two-channel digital signals are corrected by the correcting circuits 17, 18 with respect to the characteristics of the headphones and sound sources that are used. Then, the two-channel digital signals are amplified by the power amplifiers 21, 22 and supplied to the headphone 24.

Thus, it is possible to achieve a reproduction effect which allows the listener to perceive as if he listened to reproduced sounds from the speakers located in the virtual sound source positions.

Particularly in the above embodiment, the position detector 63 for detecting the relative relationship such as the distance between the screen of the video signal reproducing apparatus 62 and the listener 23, the angle made thereby or the like supplies the signal indicative of the detected position to the detecting circuit 64. Based on the signal indicative of the detected position from the position detector 63, the detecting circuit 64 supplies the control signal used to switch the address of the address control circuit 34 to the switcher 36. The switch signal based on the screen size of the screen of the video signal reproducing apparatus 62 is supplied through the input terminal 65 to the switcher 36.

The memory 35 includes three sets of the above tables, each of sets having the different data value depending upon the relative positional relationship such as the distance between the screen of the video signal reproducing apparatus 62 and the listener 23, the angle made thereby, the screen size of the screen of the video signal reproducing apparatus 62 and so on. The optimum set of the three sets of tables is selected by switching the address of the address control circuit 34 by switching the switcher 36 thereof.

Thus, the address of the address control circuit 34 is switched in accordance with the relative positional relationship such as the distance between the screen of the video signal reproducing apparatus 62 and the listener 23, the angle made thereby or the like, and the optimum table is selected. It is possible that the position of the reproduced sound image corresponds to both or either of the positions, on the screen of the video signal reproducing apparatus 62, for example, of the microphone and the sound source used when the sound is picked up.

The address of the address control circuit 34 is switched in accordance with the screen size of the screen of the video signal reproducing apparatus 62, and the optimum table is selected. It is possible that, even when the screen size of the video signal reproducing apparatus 62, for example, is switched, the position of the reproduced sound image corresponds to both or either of the positions, on the screen having the switched screen size, for example, of the microphone and the sound source used when the sound is picked up.

While in the above embodiment the switcher 36 of the address control circuit 34 is switched based on the positional information from the position detector 63 and a relative address used to read out the table of the memory is changed to thereby move a position of a sound field, it may be employed that a plurality of tables are previously prepared in the memory, the impulse response or the control signal is read out therefrom when the positional information is changed by the positional information from the position detector 63, and by changing the audio signals in time and level, the listener 23 perceives as if the position of the sound source was changed.

While FIGS. 1, 7 and 8 show only arrangements used when the single listener 23 listens to the reproduced sounds, when the plurality of listeners 23 listen to the reproduced sound, stages succeeding the convolution integrators 5, 7, 9 and 11 shown in FIG. 7 are branched off by terminals or stages succeeding the address 15, 16 shown in FIG. 8 are branched off by terminals.

In these cases, it is sufficient that the signals are processed in response to the gyration of the head of each listener after corrected and converted by the convolution integrators 5, 7, 9 and 11 and the memories 6, 8, 10 and 12 into the digital signals having the spatial information. Therefore, it is unnecessary to prepare the expensive A/D converters 3 and convolution integrators 5, 7, 9 and 11 which are as many as the number of the listeners.

Thus, it is sufficient to prepare the headphones 24, the digital angle detectors 28, and the detecting circuits 31 and 32, the up/down counters 33, the address controlling circuits 34, the memories 35 and the control apparatus 50 to 53, 54 and 56 for processing signals indicative the detected angle which are as many as the number of the listeners. It is possible to simultaneously supply the audio signal to a plurality of listeners with inexpensive costs.

In this case, when the listener 23 turns the head, the digital angle detector 28 or the analog angle detector 38 generates the digital signal or the analog signal in response to the direction of the movement of the head. Thus, the signal has a value in response to the direction of the head of the listener 23. The value is supplied therefrom through the address control circuit 34 as the address signal to the memory 35.

There are read from the memory 35 the digitally recorded impulse responses, corresponding to the direction of the head of the listener 23, from the virtual sound positions with respect to the reference direction of the head to both the ears among the data corresponding to those stored in the table shown in FIG. 4 or the control signals representing the difference in time between the sounds obtained at both the ears and the difference in level therebetween among the data shown in FIG. 6. The read data are supplied to the convolution integrators 5, 7, 9 and 11 and the memories 6, 8, 10 and 12 or the control apparatus 50, 51, 52, 53, 54 and 56.

When the analog angle detector 38 is used, the output therefrom is amplified by the amplifier 42 and converted by the A/D converter 33 into the digital signal in response to the direction of the head of the listener 23. The digital signal is supplied as the address signal through the address control circuit 34 to the memory 35. Similarly to the processings of the signal from the digital angle detector 28, there are read out from the memory the digitally recorded impulse responses, corresponding to the direction of the head of the listener 23, from the virtual sound positions with respect to the reference direction of the head to both the ears or the control signals shown in FIG. 6 representing the difference in time between the sounds obtained at the ears and the difference in level therebetween. The read data are supplied to the convolution integrators 5, 7, 9 and 11 and the memories 6, 8, 10 and 12 or the control apparatus 50, 51, 52, 53, 54 and 56.

The correcting circuits 17, 18 have one, combination or all of the correction characteristics used to correct the characteristics inherent in the sound sources, the sound field and the headphones to be used. Accordingly, since the correcting circuits can carry out the digital signal processings including the above correction at once, they can carry out the signal processing in a real-time fashion.

Since, as described above, the audio signals L, R to be supplied to the headphone 24 are corrected based on the digitally recorded impulse responses from the virtual sound source positions corresponding to the head direction of the listener 23 with respect to the reference direction of the head to both the ears or the control signals representing the difference in time between the sounds obtained at both the ears and the difference in level therebetween, it is possible to obtain the sound field which allows the listener to feel as if a plurality of speakers were located at the virtual sound source positions and the audio signals were reproduced thereby.

The control signals which are digitally recorded in the table of the memory 35 and represent the difference in time between the sounds obtained at both the ears and the difference in level therebetween are read out therefrom. Since the data of the control signals are purely electronically supplied to the control apparatus 50, 51, 52 and 53 in order that the control apparatus correct the digital signals previously convoluted by the convolution integrators 5, 7, 9 and 11 and the memories 6, 8, 10 and 12, the characteristics of the audio signals can be changed without delay after the listener 23 turns the head. Therefore, the listener is prevented from feeling unnatural.

At this time, reverberation signals generated by reverberation circuits 13, 14 are supplied to the headphone 24 so that such a spacial impression as is obtained in a listening room and a concert hall is added to the audio signals. Therefore, it is possible for the listener to perceive an excellent stereophonic sound field.

While the apparatus is directly connected to the headphone 24 through signal lines in the above-mentioned arrangements, the signals may be transmitted thereto in a wireless fashion by providing a modulator and a transmitter at a stage succeeding the convolutional integrators 5, 7, 9 and 11 shown in FIG. 7 and a receiver and a demodulator on the headphone 24 side and receiving a transmitted signal by the receiver and the modulator or by providing a modulator and a transmitter at a stage succeeding the adders 15, 16 shown in FIG. 8 and a receiver and a modulator and receiving a transmitted signal by the receiver and the modulator.

If change amounts of the digitally recorded control signals representing the difference in time between the sounds obtained at both the ears and the difference in level therebetween obtained when the angle θ is changed are set to be larger or smaller than a standard value by setting a table, then amounts of positional changes of the sound images with respect to the head direction of the listener 23 are different from each other. Therefore, it is possible to change perception of distance from the listener 23 to the sound image and to set the perception in accordance with a screen size.

Since the reverberation signals generated by the reverberation circuits 13, 14 are added to the reproduced sounds and allows the listener to listen to the reproduced sounds as if the sounds were sounds reflected by a wall of a hall or a reverberation sounds, it is possible to obtain the presence which allows the listener to feel as if he listened to the music in a famous concert hall.

Figure 11:
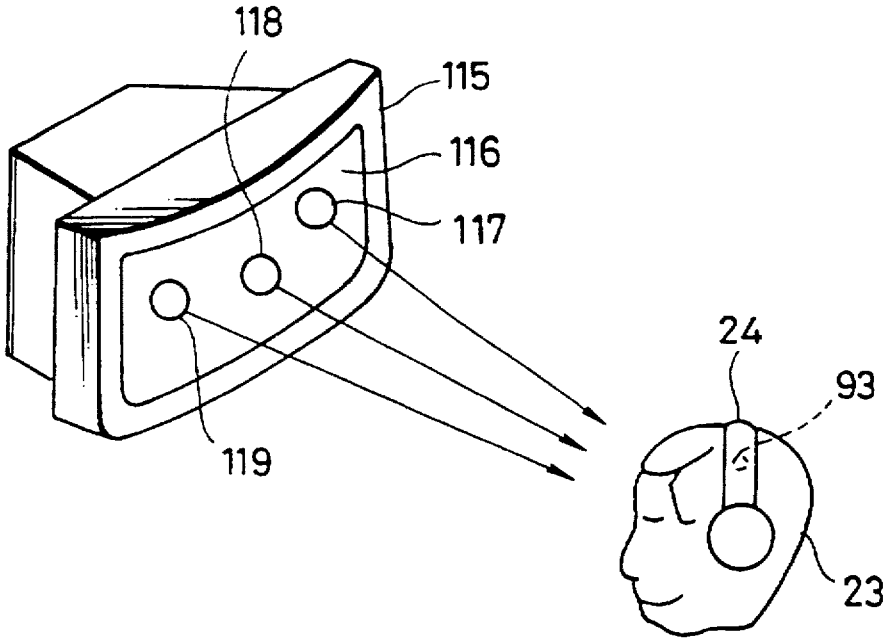
FIG. 11 is a diagram used to explain a position of a reproduced sound image of the video signal and audio signal reproducing apparatus according to the embodiment of the present invention.

FIG. 11 shows positions of the reproduced sound images. Directivity of the sound image is controlled by the information indicative of the microphone position and the information indicative of the sound source position supplied from the positional information detecting apparatus 103 and 105 shown in FIG. 10. Sounds corresponding to the sound sources are controlled in their directions so as to be oriented from the sound sources corresponding to positions of objects 117, 118 and 119 reproduced on a screen 116 as a display unit of a TV monitor and located at the positions of the objects 117, 118 and 119. Thus, real sound image positions are determined at positions from which beams of positions corresponding to the sound source positions on the screen 116 of the TV monitor 115 are oriented. It is possible to form the real sound image at the TV monitor 115 as if the sounds were emanated from the positions of the sound sources in the image displayed on the screen 116 of the TV monitor 115.

Figure 9:
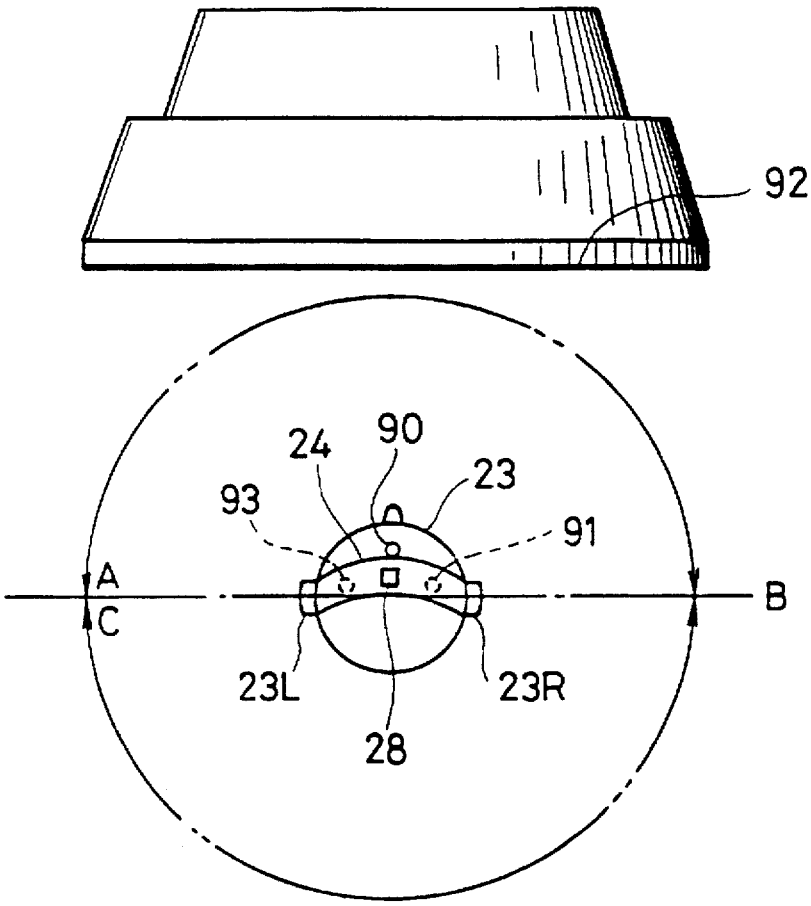
FIG. 9 is a diagram showing a simulated arrangement of speakers of the video signal and audio signal reproducing apparatus according to the embodiment of the present invention.

At this time, as shown in FIG. 9, a positional information changer 93 is provided on an inner side of the headphone 24. When the listener 23 wears the headphone 24, the switch of the positional information changer is turned on. When the listener 23 rotates with respect to the reference direction or moves close to or away from the reference position, it is possible to change the coordinates of the information indicative of the microphone positions and the information indicative of the sound source positions and supplied from the positional information detecting apparatus 103, 105 shown in FIG. 10 in accordance with the listener's movement. Specifically, in FIG. 11, the real sound image positions are determined at positions from which beams of positions corresponding to the changed sound source positions on the screen 116 of the TV monitor 115 are oriented. It is possible to form the real sound image at the TV monitor 115 as if the sound was emanated from the positions of the changed sound sources in the image displayed on the screen 116 of the TV monitor 115.

The positional information changer 93, shown in FIGS. 9 and 11, provided on the inner side of the headphone 24 corresponds to the position detector 63 and the detecting circuit 64 shown in FIGS. 1, 7 and 8. The TV monitors 92, 115 shown in FIGS. 9 and 11 correspond to the video signal reproducing apparatus 62 shown in FIGS. 1, 8 and 9.

In the above arrangement, the reference direction and the reference position may correspond to the TV monitor 92 or may be changed arbitrarily. The positional information changer 93 may be a simple input apparatus, e.g., a personal computer, for example.

The positional information changer 93 may change a specific part of the coordinates of the information indicative of the microphone position and the information indicative of the sound source positions supplied from the positional information detecting apparatus 103, 105 shown in FIG. 10 to add changed positional information to original positional information.

According to the above embodiment, based on the signal corresponding to the angle from the digital angle detector 28 and the analog angle detector 38 as the angle detecting means, the addresses of the memories 6, 8, 10 and 12 or the memory 35 are designated by the address signal from the address control circuit 34 as the address signal converting means. The impulse responses or the control signals stored in the memories, 6, 8, 10 and 12 or the memory 35 as the storage means are read out therefrom. Based on the impulse responses or the control signals, the audio signals are corrected by the convolutional integrators 5, 7, 9 and 11 or the control apparatus 50, 51, 52, 53, 54 and 56 as the control means. The audio signals are corrected in a real-time fashion with respect to the head movement of the one or plurality of listeners 23. The audio signals corrected by the convolutional integrators 5, 7, 9 and 11 or the control apparatus 50, 51, 52, 53, 54 and 56 as the control means are reproduced by the headphone 24 such that a plurality of reproduced sound images are localized at the positions corresponding to the image reproduced by the video signal reproducing apparatus 62 and the TV monitors 92 and 115 as the video reproducing means based on the reproduced sound image position information indicative of both or either of the positions of the microphones 104, 106, 107 and 108 used upon the pickup of a sound and the positions of the sound sources 100, 101 and 102 used upon the pickup of the sound. The positional information detector 93 as the reproduced sound image position information changes the coordinates of the reproduced sound image position information in response to the head movement of the listener 23. Thus, it is possible to localize the reproduced sound images in a bidirectional fashion.

According to the above embodiment, since the positional information changer 93 as the reproduced sound image position information changing means changes the coordinates of the reproduced sound image position information based on at least the information indicative of the gyration with respect to the reference direction and the information indicative of the listener's movement close to or away from the reference position, it is possible to change the coordinates of the reproduced sound image when the listener is moved.

According to the above embodiment, since the positional information changer 93 as the reproduced sound image position information changing means changes the coordinates of the reproduced sound image position information by adding thereto at least the information indicative of the gyration with respect to the reference direction and the information indicative of the listener's movement close to or away from the reference position, it is possible to change a part of the coordinates of the reproduced sound image when the listener is moved.

By controlling the directivity of the sound images based on the information indicative of the microphone positions and the information indicative of the sound source positions and supplied from the positional information detecting apparatus 103 and 105 shown in FIG. 10 and orienting the corresponding sounds from the positions of the objects 117, 118 and 119 reproduced on the screen 116 as the display unit of the TV monitor 105, a plurality of reproduced sound images may be localized at the positions of the objects 117, 118 and 119 reproduced on the screen of the TV monitor with corresponding to the respective positions.

Thus, real sound image positions are localized at positions from which beams of positions corresponding to the sound source positions on the screen 116 of the TV monitor 115 are oriented. It is possible to form the real sound image at the TV monitor 115 as if the sound was emanated from the positions of the sound sources in the image displayed on the screen 116 of the TV monitor 115.

According to the above embodiment, since the audio signals corrected by the convolutional integrators 5, 7, 9 and 11 and the control apparatus 50, 51, 52, 53, 54 and 56 are reproduced by the headphone 24 based on the reproduced sound image position information indicative of both or either of the positions of the microphones 104, 106, 107 and 108 and the positions of a plurality of the sound sources 100, 101 and 102 such that a plurality of reproduced sound images are localized at the positions of a plurality of objects 117, 118 and 119 of the image reproduced by the TV monitors 92 and 115 with corresponding to respective positions, it is possible to form the real sound images which allow the listener to feel as if the sounds were emanated from the positions of the plurality of objects 117, 118 and 119 of the reproduced image.

In FIG. 10, the image reproduced from the video signal may include images of the sound-sources 100, 101 and 102, and by controlling the directivity of the sound images based on the information indicative of the microphone positions and the information indicative of the sound source positions and supplied from the positional information detecting apparatus 103 and 105 and orienting the corresponding sounds from the positions of the objects 117, 118 and 119 reproduced on the screen 116 as the display unit of the TV monitor 115, a plurality of reproduced sound images may be localized at the positions of the objects 117, 118 and 119 reproduced on the screen of the TV monitor with corresponding to the positions.

Thus, real sound image positions are defined at positions from which beams of positions corresponding to the sound source positions on the screen 116 of the TV monitor 115 are oriented. It is possible to form the real sound image at the TV monitor 115 as if the sound was emanated from the positions of the sound sources in the image displayed on the screen 116 of the TV monitor 115.

According to the above embodiment, since the image reproduced from the video signal includes the images of the sound sources 100, 101 and 102 and the audio signals corrected by the convolutional integrators 5, 7, 9 and 11 and the control apparatus 50, 51, 52, 53, 54 and 56 are reproduced by the headphone 24 based on the reproduced sound image position information indicative of the positions of a plurality of the sound sources 100, 101 and 102 such that the reproduced sound images are localized at the positions of a plurality of objects 117, 118 and 119 of the image reproduced by the TV monitors 92 and 115 with corresponding to respective positions, it is possible to form the real sound images which allow the listener to feel as if the sounds are emanated from the positions of the plurality of objects 117, 118 and 119 of the reproduced image.

In FIG. 10, the positions of the microphones 104, 106, 107 and 108 may be changed in response to a scene of the image reproduced from the video signal, and by controlling the directivity of the sound images based on the information indicative of the microphone positions supplied from the positional information detecting apparatus 103 and 105 and orienting the corresponding sounds from the respective positions of the objects 117, 118 and 119 reproduced on the screen 116 as the display unit of the TV monitor 115, a plurality of reproduced sound images may be localized at the positions of the objects 117, 118 and 119 with corresponding to the positions.

Thus, real sound image positions are defined at positions from which beams of positions corresponding to the sound source positions on the screen 116 of the TV monitor 115 are oriented. It is possible to form the real sound image at the TV monitor 115 as if the sound was emanated from the positions of the sound sources in the image displayed on the screen 116 of the TV monitor 115.

According to the above embodiment, since the positions of the microphones 104, 106, 107 and 108 may be changed in response to a scene of the image reproduced from the video signal and the audio signals corrected by the convolutional integrators 5, 7, 9 and 11 and the control apparatus 50, 51, 52, 53, 54 and 56 are reproduced by the headphone 24 based on the reproduced sound image position information indicative of the positions of the microphones 104, 106, 107 and 108 upon picking up sounds such that the reproduced sound images are localized in the directions to the positions of the microphones 104, 106, 107 and 108 of the image reproduced by the TV monitors 92 and 115, it is possible to form the real sound images which allow the listener to feel as if the sounds were emanated from the directions of the positions of the microphones 104, 106, 107 and 108 of the reproduced image.

At this time, as shown in FIG. 9, a reset switch 90 is provided at the headphone 24. When the listener 23 presses the reset switch, the reference position of the head gyration is set. A reset switch 91 may be provided on an inner side of the headphone 24 to reset the reference position during a predetermined time when the listener wears the headphone 24.

According to the above embodiment, since the digital angle detector 28 and the analog angle detector 38 have the reset switches 90 and the direction in which the listener 23 turns the head when the reset switch 90 is turned on is set as the reference direction, it is possible to set an optional direction as a front direction by operation of the reset switch 90.

According to the above embodiment, since, when the listener 23 turns the head in the predetermined reference direction and the digital angle detector 28 and the analog angle detector 38 set the direction as the reference direction, it is possible to automatically set the predetermined direction as the reference direction.

According to the above embodiment, since the headphone 24 includes the reset switch 91 and the digital angle detector 28 and the analog angle detector 38 set the direction toward the front of the screen of the TV monitor 92 as the reference direction when the listener 23 wears the headphone 24, it is possible to always set the direction toward the picture screen as the front direction whenever the listener wears the headphone 24.

In FIGS. 9 and 11, the TV monitors 92 and 115 may be a movie screen, for example. In this case, the screen may have a plurality of the screen sizes such as a cinema scope size, a vista size or the like and the reproduced sound image may be localized in accordance with the screen size based on the reproduced sound image position information indicative of both or either of the microphone positions and the sound source positions obtained when the sounds are picked up. In this case, the positional information changer 93 may be provided with the input terminal 65 shown in FIGS. 1, 7 and 8 to input a switching signal in accordance with the screen size to the input terminal 65.

According to the above embodiment, since the screen has a plurality of the screen sizes and the audio signals corrected by the convolutional integrators 5, 7, 9 and 11 and the control apparatus 50, 51, 52, 53, 54 and 56 are reproduced by the headphone 24 such that a plurality of reproduced sound images are localized in the direction corresponding to the image reproduced on the screen with corresponding to the screen size by changing kinds of tables of the memory 35 or the memories 6, 8, 10 and 12 or the change amounts read therefrom based on the reproduced sound image position information indicative of both or either of thee microphone positions and the sound source positions obtained when the sounds are picked up, it is possible to localize the plurality of reproduced sound images in the direction corresponding to the image even if the screen size of the screen is changed.

In FIGS. 9 and 11, by locating the TV monitors 92 and 115 or the screens on the front, rear, left and right sides of the listener 23, for example, the reproduced sound images may be localized so as to correspond to the images on the screens based on the reproduced sound image position information indicative of both or either of the microphone positions and the sound source positions obtained when the sounds are picked up.

Particularly in an amusement equipment, the arrangement according to the above embodiment is suitable for use in localizing the reproduced sound images in response to the movement of the image in the movement direction of the image based on the reproduced sound image position information indicative of both or either of the microphone positions and the sound source positions obtained when the sounds are picked up. It is also possible to localize the positions of the reproduced sound images in a bidirectional fashion.

Further, while only the direction of the head of the listener 23 in a horizontal plane is described in the above-mentioned arrangements, the directions thereof in a vertical plane and planes perpendicular to both the vertical and horizontal planes can be processed similarly.

Further, data shown in FIG. 4 can be obtained as follows. Specifically, impulse sound sources and dummy-head microphones of necessary channel number are disposed at predetermined positions in a suitable room such that a preferable reproduced sound field should be obtained when the sound is reproduced by the headphone 24. In this case, the speakers may be used as sound sources used to measure the impulses.

Positions where sound waves are picked up in each of ears of the dummy head may be anywhere from the inlets of the external auditory canal thereof to the eardrum thereof. However, the positions should be equal to positions used to obtain the correction characteristics for canceling the characteristics inherent in the headphones to be used.

The control signals can be measured by radiating impulse sounds from the speakers in the respective channels and picking up the radiated impulse sounds with microphones provided in the ears of the dummy head at every constant angle $\Delta\theta$. Accordingly, since one set of impulse responses is obtained per channel at a certain angle $\theta 1$, if the signal sources has five channels, then five sets of control signals, i.e., ten control signals can be obtained per angle. Accordingly, the control signals representing the difference in time between the sounds obtained at the left and right ears and the difference in level therebetween are obtained from the impulse responses.

The correction characteristics for canceling the characteristics inherent in the sound sources, the sound field, the headphones which are used, and so on are calculated in such a manner that the same dummy-head microphones as those used to obtain impulse responses of a sound field are used, the headphone to be used are mounted on the dummy head, and impulse responses having inverted characteristics of impulse responses between the microphones in the respective ears of the dummy head are calculated from inputs from the headphone.

Alternatively, the correction characteristics may be directly calculated by using adaptive processings such as an LMS algorithm or the like so as to become approximate to a desired value as a correction value for canceling the characteristics inherent in the headphone. Specific correction of characteristics inherent in the headphones can be realized by either subjecting the digital audio signals to the convolution integral with the impulse responses representing the calculated correction characteristics in view of a processing in a time domain or filtering the analog signal obtained by the D/A conversion by an analog filter having inverted characteristics in view of an analog signal processing at any time from a time when the audio signals are input to a time when the audio signals are supplied to the headphone.

Even if one set of the tables in the memory 35 is prepared and designation of the addresses in the table is changed by the address control circuit 34, the control data can be obtained similarly to a case where the memory has plural sets of tables.

The data stored in the table may be limited to a range of a general direction of the head of the listener 23. The angle $\theta$ may be changed at different intervals depending upon the direction of the head such that the angle $\theta$ is set to be changed at an interval of 0.50° in the vicinity of $\theta=0°$ and to be changed at an interval of 3° in the range of $|\theta \geqq 45°|$. As described above, the angle may be set to be the angle through which the listener can perceive that he turns the head. Moreover, speakers disposed near the respective ears of the listener 23 may be substituted for the headphone 24.

In each of the above-mentioned arrangements, the input audio signals may be digitally recorded signals or signals recorded in an analog fashion both of which are picked up in a multichannel stereophonic mode or the like. The angle detection means for detecting the movement of the head of the listener 23 may output a digital signal or an analog signal.

When the characteristics of audio signals supplied to the headphone 24 are changed in synchronism with the movement of the head of the listener 23, the characteristics are changed not continuously in response to the movement of the head of the listener 23 but by reading data from the tables of the memory 35 at either of every constant unit angle and every predetermined angle which are necessary and sufficient for human beings to recognize in accordance with human auditory characteristics. Therefore, the same effect as that achieved when the characteristics of the audio signals are continuously changed can be achieved only by calculation with resect to necessary and sufficient changes in the movement of the head of the listener 23. Accordingly, the storage capacity of the memory 35 can be saved and high-speed calculations more than required becomes unnecessary in view of a processing speed of calculations.

Since binaural characteristics from fixed sound sources in the fixed direction are constantly obtained regardless of the gyration of the head of the listener 23, the listener obtains a highly natural localization.

Since the digital signals previously subjected to the convolution integral with the impulse responses by the convolution integrators 5, 7, 9 and 11 and the memories 6, 8, 10 and 12 are controlled by purely electronic correction using the characteristics represented by the digitally recorded control signals representing the difference in time between the sounds obtained at the respective ears and the difference in level therebetween, the characteristics are prevented from being largely deteriorated. Since the characteristics of the audio signals are changed without delay after the listener 23 turns the head, the listener is prevented from feeling such unnaturalness as he feels when using a conventional system.

Since the change amounts of the control signals representing the difference in time between the sounds obtained at the respective ears and the difference in level therebetween obtained when the angle θ is changed are set to be larger or smaller than the standard value depending upon the tables, amounts of positional changes of the sound images with respect to the head direction of the listener 23 are different from each other. Therefore, it is possible to change perception of distance from the listener 23 to the sound image and to set the perception in accordance with the screen size.

Since the suitable reverberation signals generated by the reverberation circuits 13, 14 are added to the reproduced sounds if necessary, it is possible to obtain the presence which allows the listener to feel as if he listened to the music in a famous concert hall.

According to the embodiment, since the audio signals are corrected in response to the respective gyrations of the heads of a plurality of listeners 23 based on the control signals representing the difference in time between the sounds obtained at the respective ears and the difference in level therebetween, the audio signals can be reproduced by a plurality of headphones 24 simultaneously and it is unnecessary to prepare the expensive A/D converters 3 and the expensive convolution integrators 5, 7, 9 and 11 which are as many as the number of the listeners 23. Therefore, the apparatus can be arranged with considerably inexpensive costs.

Further, in the above arrangements, the vibratory gyroscope may be used as the head gyration detector. With this arrangement, it is possible for a head gyration detector to be small and light, to have low consumed power and long lifetime, and further to be easy to handle and inexpensive.

Moreover, since the vibratory gyroscope does not utilize an inertial force but is operated by a Coriolis force, it is unnecessary to dispose the vibratory gyroscope in the vicinity of a center of the gyration of the head of the listener 23 and hence the vibratory gyroscope may be attached to any portion of the gyration detection unit. Therefore, it is possible to simplify its arrangement and fabrication.

A video signal and audio signal reproducing apparatus according to another embodiment of the present invention will hereinafter be described with reference to FIGS. 12 to 14.

According to the video signal and audio signal reproducing apparatus of the embodiment of the present invention, when a video signal and an audio signal having reproduced sound image position information indicative of both or either of the positions of the microphones used upon the sound pickup and the positions of the sound sources used upon the sound pickup are reproduced through a headphone while a listener watches a picture, the listener can perceive the equivalent localization, sound field and so on to those perceived when the audio signals are reproduced by speakers located in a predetermined positional relationship in which the speakers should be located when the audio signals are reproduced by the headphones. Particularly, a plurality of reproduced sound images are located in the direction corresponding to the picture on the basis of the reproduced sound image position information indicative of the position of the microphone and the position of the sound source or the position of either one thereof.

Specifically, the video signal and audio signal reproducing apparatus according to the embodiment of the present invention is used in a system of reproducing multichannel video and audio signals, which are obtained by picking up a sound in a stereophonic fashion or the like and have the reproduced sound image position information indicating both or either of the microphone position and the sound source position obtained when the sound is picked up, through the headphone while the listener watches a picture. Particularly, when digitized audio signals in respective channels to be recorded or transmitted are reproduced by the headphone or the like, the reproduced sound images in a plurality of channels are localized at a position corresponding to the picture based on the reproduced sound image position information indicating both or either of the microphone position and the sound source position obtained when the sound is picked up.

FIG. 12 shows an example of the video signal and audio signal reproducing apparatus according to the present invention. The arrangements shown in FIGS. 12 to 14 correspond to those shown in FIGS. 1, 7 and 8, respectively. Only different points of the arrangements shown in FIGS. 12 to 14 from those shown in FIGS. 1, 7 and 8 will be described and the common arrangements and operations need not be described.

In each of the arrangements shown in FIGS. 12, 13 and 14, the video signal is supplied to the video signal reproducing apparatus 62 and to a positional information extracting circuit 66. The positional information extracting circuit 66 is a circuit for previously extracting the reproduced sound image position information supplied together with the video signal. The reproduced sound image position information indicates both or either of the positions, on the screen of the video signal reproducing apparatus 62, of the microphone and the sound source used when the sound is picked up.

The positional information from the positional information extracting apparatus 66 is supplied to the switcher 36 for switching the address of the address control circuit 34. The switching signal generated in accordance with the screen size of the screen of the video signal reproducing apparatus 62 is also supplied to the switcher 36 through the input terminal 65.

The memory 35 includes three sets of the above tables, for example, each of sets having different data value depending upon the relative positional relationship such as the distance between the screen of the predetermined video signal reproducing apparatus 62 and the listener 23, the angle made thereby or the like, the screen size of the screen of the video signal reproducing apparatus 62 and so on. An optimum set of the three sets of tables is selected by switching the address of the address control circuit 34 by switching the switcher 36 thereof.

The video signal and audio signal reproducing apparatus according to this embodiment are arranged as described above and operates as follows. Specifically, the video signal and the audio signal are input from the input terminal 60. The separating circuit 61 separates the input signal into the video signal and the audio signal. The video signal is supplied therefrom to the video signal reproducing apparatus 62. If the audio signal separated by the separating circuit 61 is the digital audio signal, then it is supplied to the digital stereophonic signal source 1, and if it is the analog audio signal, then it is supplied to the analog stereophonic signal source 2. In this case, both the digital audio signals and the analog audio signals are the audio signals separated from the video signals having the reproduced sound image position information indicative of both or either of the microphone position and the sound source position obtained when the sound is picked up.

In the above arrangements, particularly the relative reproduced sound image position information indicative of the distance between the screen of the predetermined video signal reproducing apparatus 62 and the listener 23, the angle made thereby and so on is supplied from the positional information extracting circuit 66 to the address control circuit 34. The switching signal generated in accordance with the screen size of the screen of the video signal reproducing apparatus 62 is also supplied through the input terminal 65 to the switcher 36. The address of the address control circuit 34 is switched by switching the switcher 36.

The memory 35 includes three sets of the above tables, for example, in advance each of sets having different data values depending upon the relative positional relationship such as the distance between the screen of the predetermined video signal reproducing apparatus 62 and the listener 23, the angle made thereby or the like, the screen size of the screen of the video signal reproducing apparatus 62 and so on. An optimum set of the three sets of the tables is selected by switching the address of the address control circuit 34 by switching the switcher 36 thereof such that the reproduced sound image position is changed in response to the change of the reproduced sound image position information or the screen size.

Thus, since the address of the address control circuit 34 is switched in accordance with the relative relationship such as the distance between the screen of the predetermined video signal reproducing apparatus 62 and the listener 23, the angle made thereby and so on and an optimum table is selected, it is possible to set the reproduced sound image position in accordance with both or either of the positions, on the screen of the video signal reproducing apparatus 62, of the microphones and the sound sources used when the sounds are picked up.

Since the address of the address control circuit 34 is switched in accordance with the screen size of the screen of the video signal reproducing apparatus 62 and an optimum table is selected, even when the screen size of the video signal reproducing apparatus 62 is switched, it is possible to set the reproduced sound image position in accordance with both or either of the positions, on the screen having the switched screen size, of the microphones and the sound sources used when the sounds are picked up.

Since the audio signals L, R supplied to the headphone 24 are corrected based on the digitally recorded impulse response from the virtual sound source positions with respect to the reference direction of the head corresponding to the head direction of the listener 23 to the both ears or the control signal representing the difference in time between the sounds obtained at the both ears and the difference in level therebetween, it is possible to obtain, by localizing the reproduced sound image in accordance with the picture, the perception of the sound field which allows the listener to feel as if the audio signals were reproduced by a plurality of speakers located at the virtual sound source positions.

A video signal and audio signal reproducing apparatus according to another embodiment of the present invention will hereinafter be described in detail with reference to FIGS. 15 to 26.

According to the video signal and audio signal reproducing apparatus of the embodiment of the present invention, when an audio signal is reproduced through the headphone while the listener watches the picture, the listener can perceive the equivalent localization, sound field and so on to those perceived when the audio signals are reproduced by speakers located in a predetermined positional relationship in which the speakers should be located when the audio signals are reproduced by the speakers. Particularly, a plurality of reproduced sound images are located in the direction corresponding to the reproduced pictures projected on positions distant from left and right eyes of the listener 23 by a predetermined distance.

Specifically, the video signal and audio signal reproducing apparatus according to the embodiment of the present invention is used in a system of reproducing multichannel video and audio signals, which are obtained by picking up a sound in a stereophonic fashion or the like, through the headphone while the listener watches the picture. Particularly, when digitized audio signals in respective channels to be recorded or transmitted for localizing the respective sound images in the predetermined relationship (e.g., at right, left and center positions in front of the listener and other positions) are reproduced by the headphone or the like, the reproduced sound images in a plurality of channels are localized in the direction corresponding to the reproduced pictures projected to positions distant from the left and right eyes of the listener 23 by a predetermined distance.

FIG. 15 shows an example of the video signal and audio signal reproducing apparatus according to the present invention. Arrangements shown in FIGS. 15 to 17 respectively correspond to those shown in FIGS. 12, 13 and 14. Only different points of the arrangements shown in FIGS. 15 to 17 from those shown in FIGS. 12, 13 and 14 will be described and the common arrangements and operation need not be described.

The video signal and the audio signal are input from the input terminal 60. The separating circuit 61 separates the input signal into the video signal and the audio signal. The video signal is supplied therefrom to a video signal reproducing circuit 67. The video signal reproducing circuit 67 subjects the video signal to a predetermined pre-processing for reproduction and then supplies the processed video signal to a virtual image display 193. If the audio signal separated by the separating circuit 61 is the digital audio signal, then it is supplied to the digital stereophonic signal source 1, and if it is the analog audio signal, then it is supplied to the analog stereophonic signal source 2.

In each of the arrangements shown in FIGS. 15, 16 and 17, the video signal is supplied to the positional information extracting circuit 66. The positional information extracting circuit 66 is a circuit for previously extracting the reproduced sound image position information supplied together with the video signal. The reproduced sound image position information indicates both or either of the positions, on the screen of the virtual image display 193, of the microphone and the sound source used when the sound is picked up.

After being subjected to the predetermined pre-processing for reproduction by the video signal reproducing circuit 67, the video signal is supplied to the virtual image display 193 which the listener 23 wears.

The video signal and audio signal reproducing apparatus according to the embodiment is arranged as described above and is operated as follows. The video signal and the audio signal are input from the input terminal 60. The separating circuit 61 separates the video signal and the audio signal. The video signal is supplied therefrom to the video signal reproducing circuit 67. If the audio signal separated by the separating circuit 61 is the digital audio signal, then it is supplied to the digital stereophonic signal source 1, and if it is the analog audio signal, then it is supplied to the analog stereophonic signal source 2.

In each of the above arrangements shown in FIGS. 15, 16 and 17, particularly the relative positional information indicative of the distance between a screen of the virtual image display 193 and the listener 23, an angle made thereby and so on is supplied from the positional information extracting circuit 66 to the address control circuit 34. The switching signal generated in accordance with the screen size of the screen of the virtual image display 193 is also supplied through the input terminal 65 to the switcher 36. The address of the address control circuit 34 is switched by switching the switcher 36.

The memory 35 includes three sets of the above tables, for example, each of sets having different data value depending upon the relative positional relationship such as the distance between the screen of the virtual image display 193 and the listener 23, the angle made thereby or the like, the screen size of the screen of the virtual image display 193 and so on. An optimum set of the three sets of the tables is selected by switching the address of the address control circuit 34 by switching the switcher 36.

Thus, since the address of the address control circuit 34 is switched in accordance with the relative relationship such as the distance between the screen of the virtual image display 193 and the listener 23, the angle made thereby and so on and an optimum table is selected, it is possible to set the reproduced sound image position in accordance with both or either of the positions, on the screen of the virtual image display 193, of the microphones and the sound sources used when the sounds are picked up.

Since the address of the address control circuit 34 is switched in accordance with the screen size of the screen of the virtual image display 193 and an optimum table is selected, even when the screen size of the virtual image display 193 is switched, it is possible to set the reproduced sound image position in accordance with both or either of the positions, on the screen having the switched screen size, of the microphones and the sound sources used when the sounds are picked up.

Since the audio signals L, R supplied to the headphone 24 are corrected based on the digitally recorded impulse response from the virtual sound source positions with respect to the reference direction of the head corresponding to the head direction of the listener 23 to the both ears or the control signal representing the difference in time between the sounds obtained at the both ears and the difference in level therebetween, it is possible to obtain the perception of the sound field which allows the listener to feel as if the audio signals were reproduced by a plurality of speakers located at the virtual sound source positions.

At this time, the virtual image display 193 is supplied with information on the head movement of the listener 23 with respect to the reference direction from the digital angle detector 28 or the analog angle detector 38. Accordingly, when the listener 23 turns the head, the listener 23 may watch that the image projected at the position distant from the left and right eyes of the listener by a predetermined distance is continuously changed based on the information as if the listener was watching the image with changing the angle of his head.

Further, if the change amounts of the digitally recorded control signals representing the difference in time between the sounds obtained at the respective ears from the virtual sound source positions with respect to the reference direction of the head of the listener 23 to the both ears and obtained when the angle θ is changed and the difference in level therebetween are set to be larger or smaller than the standard value depending upon the tables, then the amounts of positional changes of the sound images with respect to the head direction of the listener 23 are different from each other. Therefore, it is possible to change perception of distance from the listener 23 to the sound image. By using the change amounts, it is possible to change the reproduced images projected on the positions distant from the left and right eyes of the listener 23 by a predetermined distance in accordance with the screen size of the virtual image display used in the video signal and audio signal reproducing apparatus.

Figure 18:
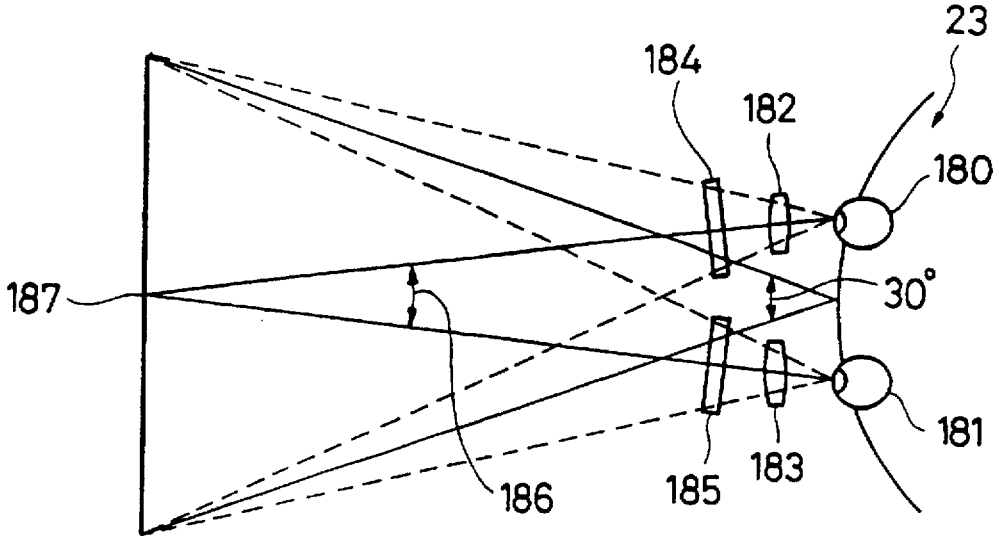
FIG. 18 is a diagram showing an operation principle of a virtual image display of a video signal and audio signal reproducing apparatus according to another embodiment of the present invention.

FIG. 18 shows a principle of an operation of the virtual image display of the video signal and audio signal reproducing apparatus according to another embodiment of the present invention. The virtual image display 193 has a liquid crystal display apparatus (hereinafter referred to as "LCD") 184 disposed in front of a right eye 180 of the listener 23 through a lens 182 and an LCD 185 disposed in front of a left eye 181 through a lens 183. Reproduced images displayed on the LCDs 184 and 185 are magnified by the lenses 182 and 183. Thus, the video signal is reproduced by projecting a virtual image 187 in front of the LCD 184 and the LCD 185.

Specifically, the image informations projected on the LCDs 184 and 185 are converted by the lenses 182 and 183 as eyepieces into the virtual images. The virtual images are input as independent informations through the right eye 180 and the left eye 181 into a brain. In the brain, the different informations are superposed on each other to form one image. In order to project the virtual image 187 on a position 1 to 1.5 m ahead of both of the eyes such that both of the eyes physiologically functions with least load, the apparatus is adjusted with an angle 186 of convergence of eyes as an angle at which the visual axes are inclined inward.

In this case, LCDs originally developed by the applicant of this invention are used as the LCDs 184 and 185, being 0.7-inch 103 thousand pixels LCD for reproducing a highly fine definite image. Since the two LCDs are used as the LCDs 184 and 185 for the right eye 180 and the left eye 182, respectively, it is possible to reproduce an image on a large screen as the virtual image 187. It is possible to employ a 3D monitor for projecting a stereoscopic image. It is possible to realize a 2D image with the same image as that projected on the LCDs 184 and 184 and a 3D image with an image with parallax.

In order to realize a small and light main body, small-sized high-magnification rectangular aspheric plastic lenses which are developed by the applicant of this application independently are employed as the lenses 182 and 183. When the plastic lenses are used, it is possible to reproduce a sharp image on an entire screen of the LCDs by suppressing distortion produced when the images projected on the LCDs 184 and 185 are magnified.

Figure 19:
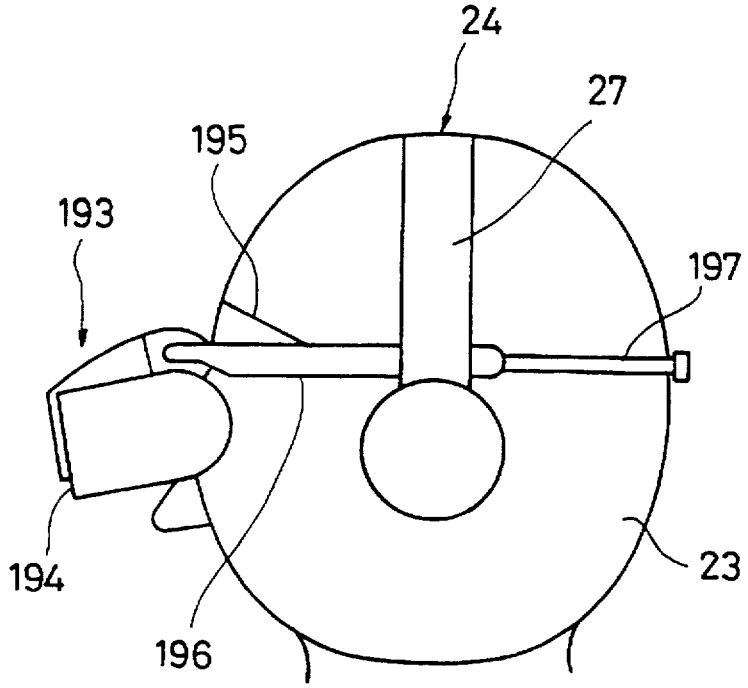
FIG. 19 is a diagram showing an appearance of the virtual image display of the video signal and audio signal reproducing apparatus according to another embodiment of the present invention.

FIG. 19 shows an appearance of the virtual image display of the video signal and audio signal reproducing apparatus according to another embodiment of the present invention. The virtual image display 193 has a scope 194 which has the lenses 182 and 183 and the LCDs 184 and 185 and which is disposed so as to cover the left and right eyes of the listener 23 and is mounted on the head of the listener 23 by using an arm 196. In this case, a forehead pad 195 supports a forehead of the listener 23 and attachment of the virtual image display can be adjusted by an adjuster 197 so as to be tighter or looser.

While the virtual image display 193 is formed independently of the headphone 24 in the above embodiment, the virtual display 193 and the headphone 24 are integrally formed with the arm 196 of the virtual image display and the head band 27 of the headphone being fixed to each other.

According to the above embodiment, since the virtual image display 193 as the video reproducing means has the LCD 185 as a left liquid crystal display unit and the LCD 184 as a right liquid crystal display unit respectively disposed at the positions corresponding to the left and right eyes of the listener 23, it is possible to project the reproduced image onto the positions distant from the left and right eyes of the listener 23 by a predetermined distance by the LCD 185 as the left liquid crystal display unit and the LCD 184 as the right liquid crystal display unit.

According to the above embodiment, since the virtual image display 193 as the video reproducing means has the LCD 185 as a left liquid crystal display unit and the LCD 184 as a right liquid crystal display unit respectively disposed through the left and right rectangular aspheric eyepieces 182 and 183 at the positions corresponding to the left and right eyes of the listener 23, it is possible to project the reproduced images onto the positions distant from the left and right eyes of the listener 23 by a predetermined distance in front of the LCD 185 as the left liquid crystal display unit and the LCD 184 as the right liquid crystal display unit by magnifying the images projected on the LCD 185 as the left liquid crystal display unit and the LCD 184 as the right liquid crystal display unit.

Figure 20:
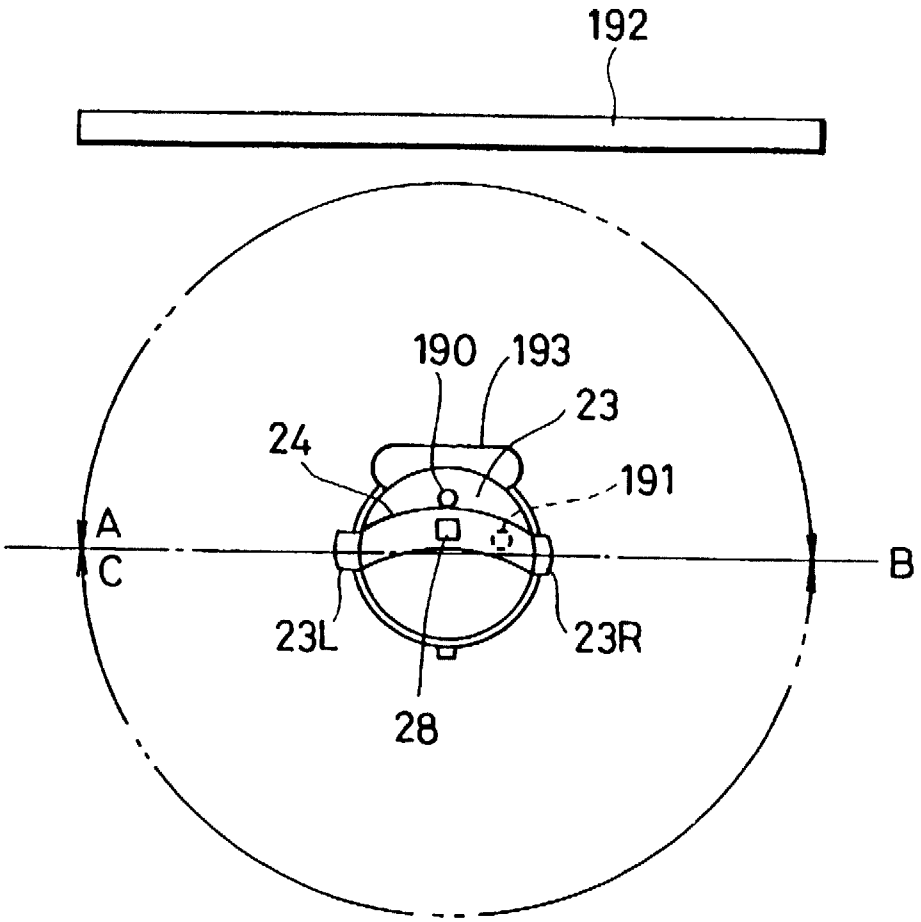
FIG. 20 is a diagram showing a simulated arrangement of speakers of a video signal and audio signal reproducing apparatus according to another embodiment of the present invention.

FIGS. 20 to 26 show simulated arrangements of the speakers of the video signal and audio signal reproducing apparatus according to another embodiment of the present invention. In FIG. 20, the direction to a virtual image position 192 on which the picture reproduced from the video signal corresponding to the audio signal is projected is set as the front direction. At this time, the simulated arrangements of the speakers are made as follows. Initially, the sound image is localized as if the speakers were disposed in a forward region A from a straight line passing through the left and right ears 23L and 23R of the listener 23. Subsequently, the sound image is localized as if the speakers were disposed in a region B on the straight line passing through the left and right ears 23L and 23R of the listener 23. Further, the sound image is localized as if the speakers were disposed in a backward region C from the straight line passing through the left and right ears 23L and 23R of the listener 23.

According to the above embodiment, since the audio signals corrected by the memories 6, 8, 10 and 12, the convolutional integrators 5, 7, 9 and 11 and the control apparatus 50, 51, 52, 53, 54 and 56 as the control means are reproduced by the headphone 24 as an audio reproducing means such that a plurality of reproduced sound images are localized in front of and behind the listener 23 in the direction corresponding to the reproduced picture projected on the position distant from the left and right eyes of the listener 23 by a predetermined distance when the video signal is reproduced by the virtual image display 193 as the video signal reproducing means, it is possible to localize the plurality of reproduced sound images in the direction corresponding to the reproduced picture projected on the position distant from the left and right eyes of the listener 23 by a predetermined distance.

Specifically, in this case, it is possible to localize the reproduced sound image in front of the listener if the picture at the virtual image position 192 is in front of the listener, behind the listener if the picture is behind the listener, on the left side of the listener if the picture is on the left side of the listener, and on the right side of the listener if the picture is on the right side of the listener. If a picture is moved, then the reproduced sound image is moved in accordance with the movement of the picture and then localized at the predetermined position.

At this time, the virtual image display 193 is supplied with information on the head movement of the listener 23 with respect to the reference direction from the digital angle detector 28 or the analog angle detector 38. Accordingly, when the listener 23 turns the head, the listener 23 may watch that the picture projected on the virtual image position 192 distant from the left and right eyes of the listener by a predetermined distance is continuously changed based on the information as if the listener was watching the picture with changing the angle of his head.

At this time, the reference position of the head gyration is set by pressing a reset switch 190 provided in the headphone 24 by the listener 23. Alternatively, the reset may be effected when the listener 23 wears the headphone 24 having a reset switch 191 on its inner side. When the listener 23 turns the head in the predetermined reference direction, the direction may be set as the reference direction.

According to the above embodiment, since the digital angle detector 28 or the analog angle detector 38 has the reset switch 190 and the direction in which the listener 23 turns the head when the reset switch 190 is turned on is set as the reference direction, it is possible to set an optional direction as the front direction by operating the reset switch 190.

According to the above embodiment, since, when the listener 23 turns the head in the predetermined reference direction, the digital angle detector 28 or the analog angle detector 38 sets the direction as the reference direction, it is possible to automatically set the predetermined direction as the reference direction.

According to the above embodiment, since the headphone 24 has the reset switch 191 and the digital angle detector 28 or the analog angle detector 38 sets the direction toward the front of the screen at the virtual image position 192 as the reference direction when the listener 23 wears the headphone 24, it is possible to constantly set the direction toward the picture screen as the front direction when the listener wears the headphone 24. While the headphone 24 is provided with the reset switches 190 and 191 in the above embodiment, the virtual image display 193 may be provided therewith.

Figure 21:
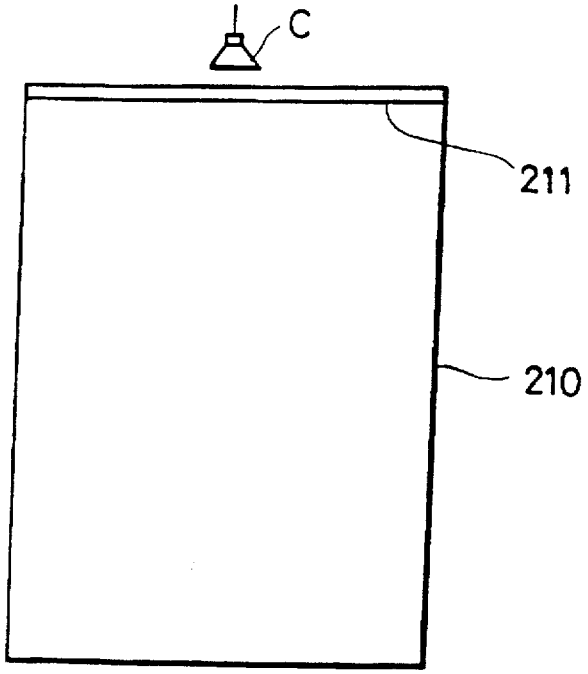
FIG. 21 is a diagram showing a simulated arrangement of a speaker for one-channel monophonic reproduction of the video signal and audio signal reproducing apparatus according to another embodiment of the present invention.

The specific simulated arrangement of the speakers are made as shown in FIGS. 21 to 26. The simulated arrangement of the speaker for one-channel monophonic reproduction is made as shown in FIG. 21. Specifically, a virtual image position 211 on which the picture is projected is disposed in front of seats 210 where the listener 23 stays. At this time, the audio signal is reproduced such that the reproduced sound image is localized as if a center speaker C was located at the center of the virtual image position 211 in front of the seats 210.

Figure 22:
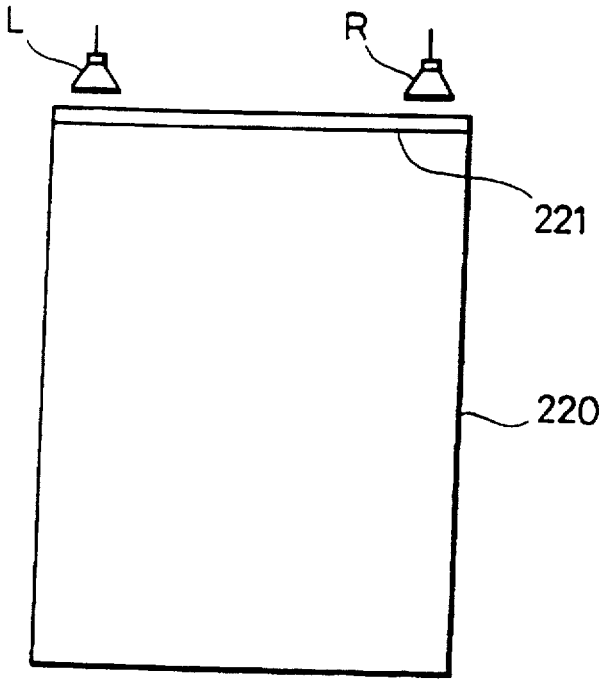
FIG. 22 is a diagram showing a simulated arrangement of speakers for two-channel stereophonic reproduction of the video signal and audio signal reproducing apparatus according to another embodiment of the present invention.

The simulated arrangement of the speakers for two-channel stereophonic reproduction is made as shown in FIG. 22. Specifically, a virtual image position 221 on which the picture is projected is disposed in front of seats 220 where the listener 23 stays. At this time, the audio signal is reproduced such that the reproduced sound image is localized as if a left speaker L and a right speaker R were respectively located on the left and right sides of the virtual image position 221 in front of the seats 220.

Figure 23:
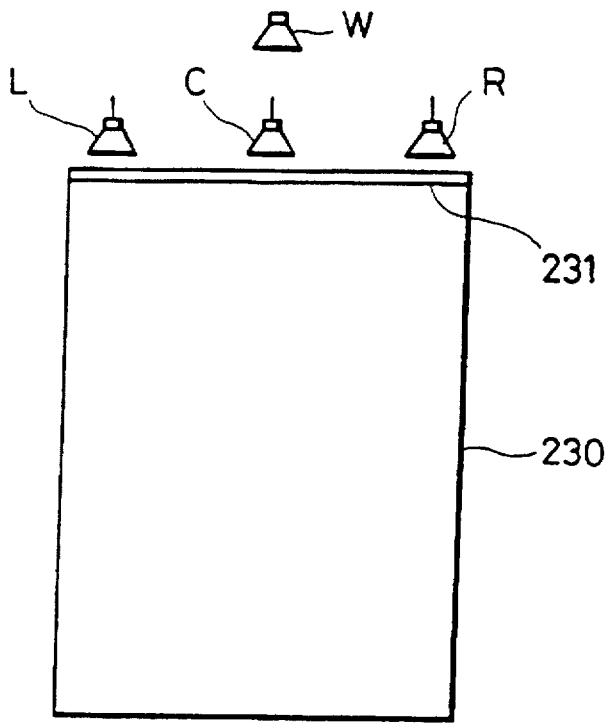
FIG. 23 is a diagram showing a simulated arrangement of speakers for three-channel reproduction of the video signal and audio signal reproducing apparatus according to another embodiment of the present invention.

The simulated arrangement of the speakers for three-channel reproduction is made as shown in FIG. 23. Specifically, a virtual image position 231 on which the picture is projected is disposed in front of seats 230 where the listener 23 stays. At this time, the audio signal is reproduced such that the reproduced sound image is localized as if a center speaker C was located at the center of the virtual image position 231 in front of the seats 230, a left speaker L and a right speaker R were respectively located on the left and right sides of the virtual image position 231, and a sub woofer speaker W was located in the vicinity of the center speaker C.

Figure 24:
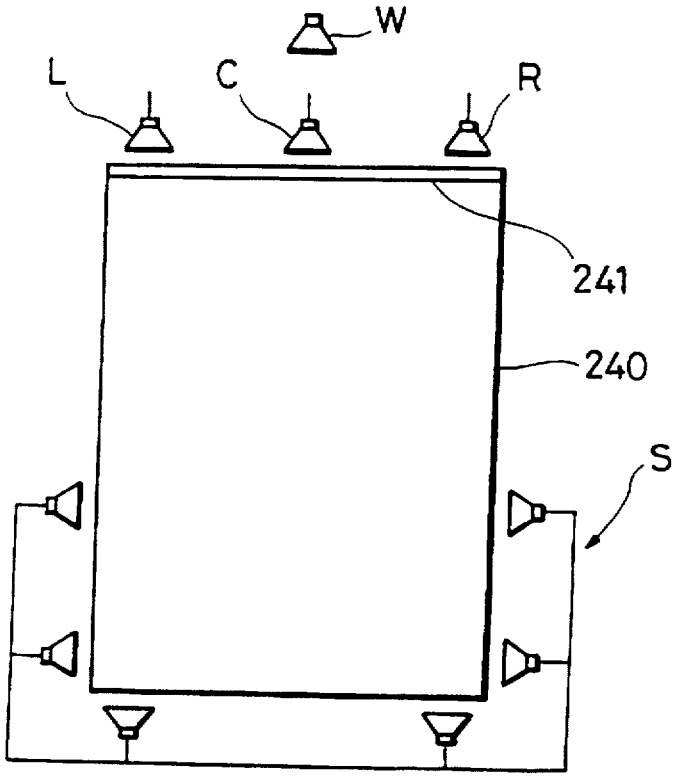
FIG. 24 is a diagram showing a simulated arrangement of speakers for four-channel reproduction of the video signal and audio signal reproducing apparatus according to another embodiment of the present invention.

The simulated arrangement of the speakers for four-channel reproduction is made as shown in FIG. 24. Specifically, a virtual image position 241 on which the picture is projected is disposed in front of seats 240 where the listener 23 stays. At this time, the audio signal is reproduced such that the reproduced sound image is localized as if a center speaker C was located at the center of the virtual image position 241 in front of the seats 240, a left speaker L and a right speaker R were respectively located on the left and right sides of the virtual image position 241, surround speakers S were located at the left and right rear position of the seats 240 and at rear left and right sides of the seats, and a sub woofer speaker W was located in the vicinity of the center speaker C.

Figure 25:
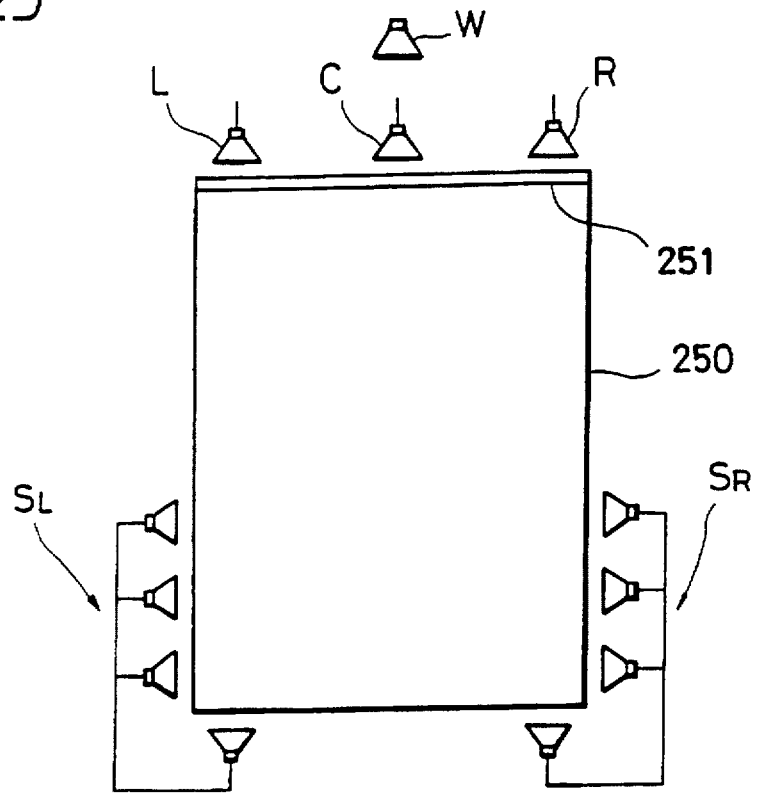
FIG. 25 is a diagram showing a simulated arrangement of speakers for five-channel reproduction of the video signal and audio signal reproducing apparatus according to another embodiment of the present invention.

The simulated arrangement of the speakers for five-channel reproduction is made as shown in FIG. 25. Specifically, a virtual image position 251 on which the picture is projected is disposed in front of seats 250 where the listener 23 stays. At this time, the audio signal is reproduced such that the reproduced sound image is localized as if a center speaker C was located at the center of the virtual image position 251 in front of the seats 250, a left speaker L and a right speaker R were respectively located on the left and right sides of the virtual image position 251, left surround speakers $S_L$ were located at the left rear position and rear left side of the seats 250, right surround speakers $S_R$ were located at the right rear position and rear right side of the seats 250, and a sub woofer speaker W was located in the vicinity of the center speaker C.

According to the above embodiment, since the audio signals corrected by the memories 6, 8, 10 and 12, the convolutional integrators 5, 7, 9 and 11 and the control apparatus 50, 51, 52, 53, 54 and 56 as the control means are reproduced by the headphone 24 as the audio reproducing means such that the five-channel reproduced sound images are localized at the center front, left and right front, and right and left rear of the listener 23 in the direction corresponding to the reproduced picture projected on the position distant from the left and right eyes of the listener 23 by a predetermined distance when the virtual image display 193 as the video reproducing means reproduces the video signal, it is possible to localize the five-channel reproduced sound images at the center front, left and right front and right and left rear of the listener 23 in the direction corresponding to the reproduced picture projected on the position distant from the left and right eyes of the listener 23 by a predetermined distance. Further, the sub woofer speaker for a channel for reproduction of only a low-frequency sound as a sub woofer channel may be provided in the vicinity of the center speaker, for example. The audio signals in eight channels or greater may be reproduced.

Figure 26:
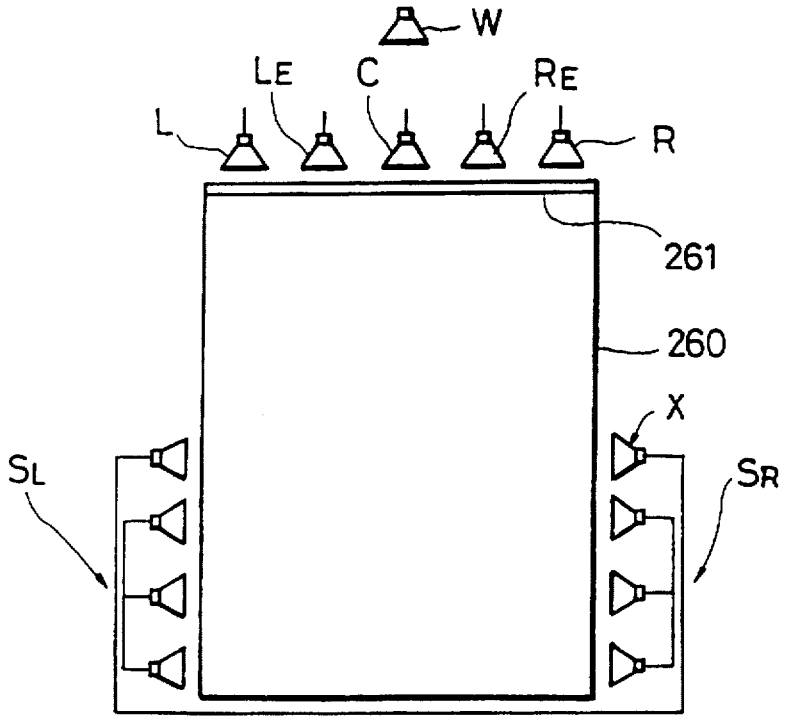
FIG. 26 is a diagram showing a simulated arrangement of speakers for front five-channel and rear two-channel reproduction of the video signal and audio signal reproducing apparatus according to another embodiment of the present invention.

The simulated arrangement of the speakers for reproduction in front five channels and rear two channels is made as shown in FIG. 26. Specifically, a virtual image position 261 on which the picture is projected is disposed in front of seats 260 where the listener 23 stays. At this time, the audio signal is reproduced such that the reproduced sound image is localized as if a center speaker C was located at the center of the virtual image position 261 in front of the seats 260, a left speaker L and a right speaker R were respectively located on the left and right sides of the virtual image position 261, a left extra speaker $L_E$ was located between the center speaker C and the left speaker L, a right extra speaker $R_E$ was located between the center speaker C and the right speaker R, left surround speakers $S_L$ were located at the left rear side of the seats 260, and right surround speakers $S_R$ were located at the right rear side of the seats 260. Further, a sub woofer speaker W for a channel for reproduction of only a low-frequency reproduced sound may be located in the vicinity of the center speaker C. ALso, eight channel speakers may be provided. Further, audio signals in eight channels or greater may be reproduced.

According to the above embodiment, since the audio signals corrected by the memories 6, 8, 10 and 12, the convolutional integrators 5, 7, 9 and 11 and the control apparatus 50, 51, 52, 53, 54 and 56 as the control means are reproduced by the headphone 24 as the audio reproducing means such that the seven-channel reproduced sound images are localized at the center front, left and right front of, at the left and right center front of, and at the right and left rear of the listener 23 in the direction corresponding to the reproduced picture projected on the position distant from the left and right eyes of the listener 23 by a predetermined distance when the virtual image display 193 as the video reproducing means reproduces the video signal, it is possible to localize the seven-channel reproduced sound images at the center front, left and right front of, at the left and right center front of, and at the right and left rear of the listener 23 in the direction corresponding to the reproduced picture projected on the position distant from the left and right eyes of the listener 23 by a predetermined distance. Further, the sub woofer speaker for a channel for reproduction of only a low-frequency sound as a sub woofer channel may be provided in the vicinity of the center speaker, for example. The audio signals in eight channels or greater may be reproduced.

In FIGS. 20 to 26, the virtual image positions 192, 211, 221, 231, 241, 251 and 261 may have a plurality of screen size such as a cinema scope size, a vista size or the like by adjusting the lenses 182 and 183 as an optical system, for example, and the reproduced sound image may be localized in accordance with the screen size thereof. At this time, in the arrangements shown in FIGS. 15, 16 and 17, the switching signal generated in accordance with the screen size is input to the input terminal 65.

At this time, the virtual image display 193 is supplied with information on the head movement of the listener 23 with respect to the reference direction from the digital angle detector 28 or the analog angle detector 38. Accordingly, when the listener 23 turns the head, the listener 23 may watch that the image projected on each of the virtual image positions 211, 221, 231, 241, 251 and 261 shown in FIGS. 21 to 26 distant from the left and right eyes of the listener by a predetermined distance is continuously changed based on the information as if the listener was watching the image with changing the angle of his head.

According to the above embodiment, since each of the virtual image positions 192, 211, 221, 231, 241, 251 and 261 has a plurality of screen sizes and the audio signals corrected by the memories and convolutional integrators 5, 6, 7, 8, 9, 10, 11 and 12 and the control apparatus 50, 51, 52, 53, 54 and 56 are reproduced by the headphone 24 such that a plurality of reproduced sound images are localized in accordance with the screen size in the direction corresponding to the reproduced picture projected on the position distant from the left and right eyes of the listener 23 by a predetermined distance by the virtual image display 193, it is possible to localize the plurality of reproduced sound images in the direction corresponding to the reproduced picture projected on the position distant from the left and right eyes of the listener 23 by a predetermined distance even if the screen sizes of the virtual image positions 192, 211, 221, 231, 241, 251 and 261 are changed.

In the arrangements shown in FIGS. 20 to 26, by locating the virtual image displays 193 in front of and behind of the listener 23 and on the left and right sides of the listener, the reproduced sound images may be respectively localized so as to correspond to the pictures on the screens at the virtual image positions 192, 211, 221, 231, 241, 251 and 261.

In the arrangements shown in FIGS. 20 to 26, by locating the virtual image displays 193 in front of and behind of the listener 23 and on the left and right sides of the listener such that the virtual image displays cover the listener 23, the reproduced sound images may be respectively localized so as to correspond to the pictures on the screens at the virtual image positions 192, 211, 221, 231, 241, 251 and 261.

Particularly in the amusement machine, the above arrangement is most suitable for use in localizing the reproduced sound images corresponding the movement of the pictures in the direction in which the picture is moved.

According to the above embodiment, since the virtual image displays 193 as the video reproduction means are disposed at least in front of and behind of the listener 23 and on the left and right sides of the listener so as to cover the listener 23 and the audio signals corrected by the memories 6, 8, 10 and 12, the convolutional integrators 5, 7, 9, and 11 and the control apparatus 50, 51, 52, 53, 54 and 56 as the control means are reproduced by the headphone 24 as the audio reproducing means such that a plurality of optional reproduced sound images are localized in the direction corresponding to the reproduced picture projected on the position distant from the left and right eyes of the listener 23 by a predetermined distance when the virtual image display 193 as the video reproduction means reproduces the video signal, it is possible to localize the plurality of reproduced sound images in front of and behind of the listener and on the left and right sides of the listener in the direction corresponding to the reproduced picture projected on the position distant from the left and right eyes of the listener 23 by a predetermined distance.

Further, while only the direction of the head of the listener 23 in the horizontal plane is described in the above-mentioned arrangements, the directions thereof in the vertical plane and the planes perpendicular to both the vertical and horizontal planes can be processed similarly.

According to the above embodiment, since the digital angle detector 28 and the analog angle detector 38 as the angle detecting means also detect angles of upward and downward gyrations of the head of the listener 23 with respect to the reference direction, the virtual image displays 193 as the video reproduction means are disposed at least in front of and behind of the listener 23, on the left and right sides of the listener and above and below the listener so as to cover the listener 23 and the headphone 24 as the audio reproducing means reproduces the audio signals corrected by the memories 6, 8, 10 and 12, the convolutional integrators 5, 7, 9, and 11 and the control apparatus 50, 51, 52, 53, 54 and 56 as the control means such that a plurality of optional reproduced sound images are localized in the direction corresponding to the reproduced picture projected on the position distant from the left and right eyes of the listener 23 by a predetermined distance when the virtual image display 193 as the video reproduction means reproduces the video signal, it is possible to localize the plurality of reproduced sound images in front of and behind of the listener, on the left and right sides of the listener and above and below the listener in the directions corresponding to the reproduced pictures projected on the positions distant from the left and right eyes of the listener 23 by a predetermined distance.

Industrial Applicability

Particularly in the amusement machine, the video signal and audio signal reproducing apparatus according to the present invention is most suitable for use in localizing the reproduced sound images corresponding the movement of the pictures in the direction in which the picture is moved, based on the reproduced sound image position information indicative of both or either of the positions of the microphones and the sound sources used when the sounds are picked up. The video signal and audio signal reproducing apparatus according to the present invention can also be used to localize the reproduced sound images in a bidirectional fashion.

We claim:

1. A video signal and audio signal reproducing apparatus comprising:

a signal source for supplying a video signal and audio signals in a plurality of channels;

storage means for storing an impulse response from a virtual sound source reference position with respect to a reference direction of a listener's head to both ears, the impulse response corresponding to a measured head movement of the listener, and for storing a control signal and a level signal corresponding respectively to a measured difference in time between audio signals from the virtual sound source reference position with respect to the reference direction of the listener's head to both ears and a measured difference in level between the audio signals from the virtual sound source reference position with respect to the reference direction of the listener's head to both ears;

an angle detecting means for detecting a head movement angle of the listener with respect to the reference direction at every predetermined angle and outputting a detected angle signal, the angle detecting means including a reset switch for selectively setting the reference direction;

address signal generating means for generating an address signal supplied to the storage means to read out the impulse response or the control signal stored in the storage means;

video signal reproducing means for reproducing the video signal supplied from the signal source;

movement detecting means for detecting a relative movement of the virtual sound source on the video signal reproducing means and the listener's head;

control means for correcting the audio signals with respect to the relative movement of the listener's head and the movement of the listener's head with respect to the position of the virtual sound source on the video reproducing means in a real-time manner based on the impulse response or the control signal read out from the storage means, the control means correcting the audio signals after an address of the storage means is designated by the address signal generated by the address signal generating means based on the detected angle signal from the angle detecting means and an output signal from the movement detecting means to thereby read out the impulse response or the control signal stored in the storage means, the control means correcting the audio signals from the signal source so that a plurality of reproduced sound images are localized at a position corresponding to a picture reproduced by the video signal reproducing means;

audio signal reproducing means adapted for mounting on the listener's head, the audio signal reproducing means receiving and reproducing the audio signals corrected by the control means so that the plurality of reproduced sound images are localized at the position corresponding to the picture reproduced by the video signal reproducing means.

2. A video signal and audio signal reproducing apparatus according to claim 1, wherein the movement detecting means includes an extracting means for extracting positional information output from the signal source together with the video signal and the audio signals and supplying an extracted signal to the control means.

3. A video signal and audio signal reproducing apparatus according to claim 1, wherein the movement detecting means includes position detecting means mounted on the listener's head for detecting a relative movement of the listener with respect to the video signal reproducing means and outputting a detection signal to the control means.

4. A video signal and audio signal reproducing apparatus according to claim 3, wherein the position detecting means is provided on the audio signal reproducing means.

5. A video signal and audio signal reproducing apparatus according to claim 3, wherein the position detecting means changes angle coordinate information of the angle detecting means based on information on head gyration of the listener with respect to the reference direction and information indicative of movement of the listener's head closer to or away from the position of the virtual sound source.

6. A video signal and audio signal reproducing apparatus according to claim 3, wherein the position detecting means adds information on head gyration of the listener with respect to the reference direction and information indicative of movement of the listener's head closer to or away from the reference position to angle information from the angle detecting means to thereby change the angle information of the angle detecting means.

7. A video signal and audio signal reproducing apparatus according to claim 1, wherein the angle detecting means sets as the reference direction a direction in which the listener's head turns when the reset switch is turned on.

8. A video signal and audio signal reproducing apparatus according to claim 1, wherein the angle detecting means sets as the reference direction a predetermined direction which the listener's head turns to.

9. A video signal and audio signal reproducing apparatus according to claim 1, wherein the reset switch causes the angle detecting means to set as the reference direction a direction toward a front of a screen of the video signal reproducing means when the listener wears the audio signal reproducing means.

10. A video signal and audio signal reproducing apparatus according to claim 1, further comprising input means for inputting a signal based on a size of a display unit of the video signal reproducing means as data and outputting a data signal to the address signal generating means, wherein the address signal generating means generates the address signal in accordance with the detected angle signal from the angle detecting means, the output signal from the movement detecting means, and the data signal from the input means.

11. A video signal and audio signal reproducing apparatus according to claim 1, wherein the angle detecting means detects upward and downward angles of gyration of the listener with respect to the reference direction, and the audio signal reproducing means reproduces the audio signals corrected by the control means based on the impulse response or the control signal read out from the storage means in accordance with the angles of gyration detected by the angle detecting means such that a plurality of optional reproduced sound images are localized at a position corresponding to a picture reproduced by the video signal reproducing means.

12. A video signal and audio signal reproducing apparatus according to claim 1, wherein the video signal reproducing means is adapted for mounting on the listener's head so as to be opposite the listener's eyes, and the video signal reproducing means projects a reproduced picture at a position separated from the listener's eyes by a predetermined distance.

13. A video signal and audio signal reproducing apparatus according to claim 12, wherein the video signal reproducing means includes a head mount body for mounting on the listener's head and a pair of display units respectively disposed at positions on the head mount body corresponding to the listener's eyes.

14. A video signal and audio signal reproducing apparatus according to claim 13, wherein the video signal reproducing means further includes a pair of rectangular aspheric lenses respectively disposed between the listener's eyes and the pair of display units.

15. A video signal and audio signal reproducing apparatus according to claim 12, wherein the video signal reproducing means includes a head mount body for mounting on the listener's head and a pair of virtual image display units respectively disposed at positions on the head mount body corresponding to the listener's eyes.

16. An audio signal reproducing apparatus comprising:

a signal source for supplying audio signals in a plurality of channels;

storage means for storing an impulse response from a reference position of a virtual sound source with respect to a reference direction of a listener's head to both ears, the impulse response corresponding to a measured head movement of the listener, and for storing a control signal and a level signal corresponding respectively to a measured difference in time between audio signals from the reference position of the virtual sound source with respect to the reference direction of the listener's head to both ears and a measured difference in level between the audio signals from the reference position of the virtual sound source with respect to the reference direction of the listener's head to both ears;

an angle detecting means for detecting a head movement angle of the listener with respect to the reference direction at every predetermined angle and outputting a detected angle signal, the angle detecting means including a reset switch for selectively setting the reference direction;

address signal generating means for generating an address signal supplied to the storage means to read out the impulse response or the control signal stored in the storage means;

movement detecting means for detecting a relative movement of the virtual sound source and the listener's head;

control means for correcting the audio signals with respect to the relative movement of the listener's head with respect to the reference position of the virtual sound source in a real-time manner based on the impulse response or the control signal read out from the storage means, the control means correcting the audio signals after an address of the storage means is designated by the address signal generated by the address signal generating means based on the detected angle signal from the angle detecting means and an output signal from movement detecting means to thereby read out the impulse response or the control signal stored in the storage means, the control means correcting the audio signals from the signal source so that a plurality of reproduced sound images are localized at the reference position of the virtual sound source; and audio signal reproducing means adapted for mounting on the listener's head, the audio signal reproducing means receiving and reproducing the audio signals corrected by the control means so that the plurality of reproduced sound images are localized at the reference position of the virtual sound source.

17. An audio signal reproducing apparatus according to claim 16, wherein the movement detecting means includes an extracting means for extracting positional information output from the signal source together with the audio signals and outputting an extracted signal to the control means.

18. An audio signal reproducing apparatus according to claim 16, wherein the movement detecting means includes position detecting means mounted on the listener's head for detecting a relative movement of the listener with respect to the reference position of the virtual sound source and outputting a detection signal to the control means.

19. An audio signal reproducing apparatus according to claim 18, wherein the position detecting means is provided on the audio signal reproducing means.

20. An audio signal reproducing apparatus according to claim 18, wherein the position detecting means changes angle coordinate information of the angle detecting means based on information on head gyration of the listener with respect to the reference direction and information indicative of movement of the listener's head closer to or away from the reference position of the virtual sound source.

21. An audio signal reproducing apparatus according to claim 18, wherein the position detecting means adds information on head gyration of the listener with respect to the reference direction and information indicative of movement of the listener's head closer to or away from the reference position of the virtual sound source to angle information from the angle detecting means to thereby change the angle detection signal from the angle detecting means.

22. An audio signal reproducing apparatus according to claim 16, wherein the angle detecting means sets as the reference direction a direction in which the listener's head turns when the reset switch is turned on.

23. An audio signal reproducing apparatus according to claim 16, wherein the angle detecting means sets as the reference direction a predetermined direction which the listener's head turns to.

24. An audio signal reproducing apparatus according to claim 16, wherein audio signal reproducing means includes a reset switch which, when the listener wears the audio signal reproducing means, causes the angle detecting means to set as the reference direction a direction toward a front of the virtual sound source.

25. An audio signal reproducing apparatus according to claim 16, wherein the angle detecting means detects upward and downward angles of gyration of the listener with respect to the reference direction, and the audio signal reproducing means reproduces audio signals corrected by the control means based on the impulse response or the control signal read out from the storage means in accordance with the angles of gyration detected by the angle detecting means such that a plurality of optional reproduced sound images are localized at a position corresponding to the virtual sound source.

26. A video signal and audio signal reproducing apparatus comprising:

a signal source for supplying a video signal and audio signals in a plurality of channels;

angle detecting means for detecting a head movement angle of a listener's head with respect to a virtual sound source reference position at every predetermined angle and outputting a detected angle signal, the angle detecting means including a reset switch for selectively setting the reference direction;

video signal reproducing means for reproducing the video signal supplied from the signal source;

movement detecting means for detecting a relative movement of the virtual sound source on the video signal reproducing means and the listener's head;

storage means for storing a plurality of correction data used to correct the audio signals from the signal source such that sound images reproduced from the audio signals from the signal source are localized at the position of the virtual sound source when the listener's head turns with respect to a reference direction;

control means for correcting the audio signals from the signal source by selectively reading out the correction data from the storage means based information indicative of an angle of the listener supplied from the angle detecting means and changes the correction data read out from the storage means based on the information indicative of the angle of the listener supplied from the angle detecting means and a movement detection signal from the movement detecting means; and audio signal reproducing means adapted for mounting on the listener's head, the audio signal reproducing means receiving and reproducing the audio signals corrected by the control means so that a plurality of reproduced sound images are localized at a position corresponding to a picture reproduced by the video signal reproducing means.

27. A video signal and audio signal reproducing apparatus according to claim 26, wherein the storage means stores the impulse response after the impulse response from the position of the virtual sound source with respect to the reference direction of the listener's head corresponding to movement of the listener's head is determined or stores a control signal representing a measured difference in time between the audio signals from the signal source the virtual sound source and a measured difference in level between the audio signals from the signal source and the virtual sound source.

28. A video signal and audio signal reproducing apparatus according to claim 27, further comprising address signal generating means for generating an address signal supplied to the storage means to read out the impulse response or the control signal stored in the storage means.

29. A video signal and audio signal reproducing apparatus according to claim 26, wherein the movement detecting means includes extracting means for extracting positional information output from the signal source together with the video signal and the audio signals and supplying an extracted signal to the control means.

30. A video signal and audio signal reproducing apparatus according to claim 26, wherein the movement detecting means includes position detecting means mounted on the listener's head for detecting a relative movement of the listener with respect to the video signal reproducing means and outputting a detection signal to the control means.

31. A video signal and audio signal reproducing apparatus according to claim 30, wherein the position detecting means is provided on the audio signal reproducing means.

* * * * *